US008894184B2

(12) United States Patent
Nozawa et al.

(10) Patent No.: US 8,894,184 B2
(45) Date of Patent: Nov. 25, 2014

(54) COVER AND LIQUID CONTAINER

(71) Applicant: Seiko Epson Corporation, Tokyo (JP)

(72) Inventors: Izumi Nozawa, Matsumoto (JP); Atsushi Kobayashi, Matsumoto (JP); Tadahiro Mizutani, Shiojiri (JP); Hiroyuki Nakamura, Shiojiri (JP); Ryota Takahashi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/900,403

(22) Filed: May 22, 2013

(65) Prior Publication Data

US 2013/0314477 A1 Nov. 28, 2013

(30) Foreign Application Priority Data

| | | |
|---|---|---|
| May 23, 2012 | (JP) | 2012-117059 |
| Jul. 6, 2012 | (JP) | 2012-152295 |
| Jul. 23, 2012 | (JP) | 2012-162701 |
| Aug. 8, 2012 | (JP) | 2012-176179 |
| Aug. 30, 2012 | (JP) | 2012-190568 |
| Aug. 31, 2012 | (JP) | 2012-191629 |

(51) Int. Cl.
*B41J 2/175* (2006.01)
*B41J 2/14* (2006.01)

(52) U.S. Cl.
CPC ..... *B41J 2/17503* (2013.01); *B41J 2/1752* (2013.01); *B41J 2/17536* (2013.01); *B41J 2/1754* (2013.01); *B41J 2/17553* (2013.01)
USPC ..... 347/49; 347/86

(58) Field of Classification Search
USPC ..... 347/7, 19, 49, 85, 86
See application file for complete search history.

(56) References Cited

U.S. PATENT DOCUMENTS

| | | | |
|---|---|---|---|
| 5,825,388 | A | 10/1998 | Sasaki |
| 5,980,032 | A | 11/1999 | Pawlowski, Jr. et al. |
| 6,086,193 | A | 7/2000 | Shimada et al. |
| 6,145,974 | A | 11/2000 | Shinada et al. |
| 6,155,678 | A | 12/2000 | Komplin et al. |
| 6,203,148 | B1 | 3/2001 | Kishida |
| 6,250,750 | B1 | 6/2001 | Miyazawa et al. |
| 6,254,226 | B1 | 7/2001 | Lengyel et al. |
| 6,585,007 | B2 | 7/2003 | Kubokawa |

(Continued)

FOREIGN PATENT DOCUMENTS

| | | | |
|---|---|---|---|
| EP | 0655336 | A1 | 5/1995 |
| EP | 0712727 | A2 | 5/1996 |

(Continued)

OTHER PUBLICATIONS

Search Report issued on Jul. 14, 2014 in European Patent Application No. 13168754.3.

*Primary Examiner* — Anh T. N. Vo
(74) *Attorney, Agent, or Firm* — Stroock & Stroock & Lavan LLP

(57) ABSTRACT

A cover for a liquid container. The liquid container comprises a first to third surfaces. The first surface has a wall which surrounds a communication port and a liquid supply portion. The third surface has an air hole communicating with the communication port and has at least one of a protrusion and a recess. The cover comprises a covering portion that covers the wall, and a first cover portion that covers the at least one of the protrusion and the recess.

12 Claims, 30 Drawing Sheets

(56) References Cited

U.S. PATENT DOCUMENTS

| | | | | |
|---|---|---|---|---|
| 6,623,104 | B1 | 9/2003 | Kotaki et al. | |
| 6,848,776 | B2 | 2/2005 | Nishioka et al. | |
| 7,237,881 | B2 | 7/2007 | Hayasaki et al. | |
| 7,393,088 | B2 | 7/2008 | Sasaki | |
| 7,470,008 | B2 | 12/2008 | Yan | |
| 7,735,983 | B2 | 6/2010 | Pearson et al. | |
| 7,918,547 | B2 | 4/2011 | Hatasa et al. | |
| 7,938,523 | B2 | 5/2011 | Aldrich | |
| 8,113,640 | B2 * | 2/2012 | Shimizu | 347/86 |
| 8,142,000 | B2 | 3/2012 | Ishizawa et al. | |
| 8,177,341 | B2 * | 5/2012 | Shinada et al. | 347/86 |
| 8,177,342 | B2 | 5/2012 | Wanibe et al. | |
| 8,366,250 | B2 | 2/2013 | Wanibe et al. | |
| 8,366,251 | B2 | 2/2013 | Wanibe et al. | |
| 2002/0104578 | A1 | 8/2002 | Kubokawa | |
| 2005/0041076 | A1 | 2/2005 | Katayama | |
| 2005/0179750 | A1 | 8/2005 | Hayasaki et al. | |
| 2005/0185034 | A1 | 8/2005 | Anma et al. | |
| 2005/0219303 | A1 | 10/2005 | Matsumoto et al. | |
| 2005/0275699 | A1 | 12/2005 | Sasaki | |
| 2007/0024683 | A1 | 2/2007 | Yan | |
| 2007/0195141 | A1 | 8/2007 | Anma et al. | |
| 2008/0204529 | A1 | 8/2008 | Matsumoto et al. | |
| 2008/0239037 | A1 | 10/2008 | Inoue et al. | |
| 2009/0128609 | A1 | 5/2009 | Matsumoto et al. | |
| 2009/0322832 | A1 | 12/2009 | Wanibe et al. | |
| 2009/0322838 | A1 | 12/2009 | Wanibe et al. | |
| 2009/0322839 | A1 | 12/2009 | Ishizawa et al. | |
| 2010/0073438 | A1 | 3/2010 | Wanibe et al. | |
| 2010/0208015 | A1 | 8/2010 | Matsumoto et al. | |
| 2010/0302291 | A1 | 12/2010 | Matsumoto et al. | |
| 2010/0309265 | A1 | 12/2010 | Matsumoto et al. | |
| 2010/0309266 | A1 | 12/2010 | Matsumoto et al. | |
| 2011/0037815 | A1 | 2/2011 | Anma et al. | |
| 2011/0169899 | A1 | 7/2011 | Nozawa et al. | |
| 2012/0127247 | A1 | 5/2012 | Anma et al. | |
| 2012/0133713 | A1 | 5/2012 | Camp | |
| 2013/0208044 | A1 | 8/2013 | Matsumoto et al. | |

FOREIGN PATENT DOCUMENTS

| | | | |
|---|---|---|---|
| EP | 0739740 | A1 | 10/1996 |
| EP | 1053876 | A2 | 11/2000 |
| EP | 1053881 | A1 | 11/2000 |
| EP | 1095777 | A2 | 5/2001 |
| EP | 1170135 | A1 | 1/2002 |
| EP | 1892104 | A1 | 2/2008 |
| JP | 08-112915 | A | 5/1996 |
| JP | 10-095129 | A | 4/1998 |
| JP | 10-250091 | A | 9/1998 |
| JP | 2000-203053 | A | 7/2000 |
| JP | 2001-063085 | A | 3/2001 |
| JP | 2001-130022 | A | 5/2001 |
| JP | 2002-036590 | A | 2/2002 |
| JP | 2002-120376 | A | 4/2002 |
| JP | 2002-225306 | A | 5/2002 |
| JP | 2005-170027 | A | 6/2005 |
| JP | 2005-349786 | A | 12/2005 |
| JP | 2007-112150 | A | 5/2007 |
| JP | 2008-246896 | A | 10/2008 |
| JP | 2009-061785 | A | 3/2009 |
| JP | 2009-241608 | A | 10/2009 |
| JP | 2010-005957 | A | 1/2010 |
| JP | 2011-140189 | A | 7/2011 |
| JP | 2011-207066 | A | 10/2011 |
| JP | 2012-035489 | A | 2/2012 |
| JP | 2012-126100 | A | 7/2012 |
| JP | 2012-136039 | A | 7/2012 |
| WO | 98/55325 | A1 | 12/1998 |

* cited by examiner

COVER AND LIQUID CONTAINER

Priority is claimed under 35 U.S.C. §119 to Japanese Application No. 2012-117059 filed on May 23, 2012, No. 2012-162701 filed on Jul. 23, 2012, No. 2012-152295 filed on Jul. 6, 2012, No. 2012-176179 filed on Aug. 8, 2012, No. 2012-191629 filed on Aug. 31, 2012, and No. 2012-190568 filed on Aug. 30, 2012 which are hereby incorporated by reference in its entirety.

BACKGROUND

1. Technical Field

The present invention relates to a technique of covering a liquid container.

2. Related Art

An existing technique of supplying ink as an example of liquid to a printer as an example of a liquid discharge apparatus has been known as a technique of using an ink cartridge (also referred to as "cartridge" simply) that accommodates the ink. The cartridge includes a liquid accommodation portion for accommodating ink and a liquid supply portion for supplying the ink in the liquid accommodation portion to the printer. The liquid supply portion forms a liquid supply port of which one edge portion communicates with the liquid accommodation portion and the other edge portion is an opening (for example, U.S. Pat. Nos. 7,735,983 and 7,938,523).

The cartridge as described in U.S. Pat. Nos. 7,735,983 and 7,938,523 receives impact at the time of conveyance and the ink in the liquid accommodation portion leaks to the outside of the cartridge before being used in some cases. In the cartridge as described in U.S. Pat. Nos. 7,735,983 and 7,938,523, a ventilation path that communicates a communication port provided in the vicinity of the liquid supply portion and a through-hole formed on the outer case of the cartridge is provided. The ventilation path is used for keeping the vicinity of the liquid supply portion to the atmospheric pressure when the cartridge is attached to the printer and so on. In the cartridge provided with the ventilation path, even if the liquid supply portion is covered by a cap at the time of the conveyance, ink leaked into the cap from the liquid supply portion due to the received impact leaks to the outside from the lid member through the above-mentioned ventilation path in some cases. Various failures occur if the ink leaks to the outside of the cartridge. For example, there arises a risk that an amount of ink capable of being used by a user is reduced. There also arises a risk that the ink adheres to the user, a printer, a print medium, or the like. In addition, there arises a risk that ink adheres to a window provided on the outer circumferential surface of the cartridge for detecting presence/absence or the like of the ink in the cartridge optically and the presence/absence or the like of the ink is detected falsely. These problems occur not only on the cartridge for the printer but also on liquid containers to be used for liquid discharge apparatuses commonly.

SUMMARY

An advantage of some aspects of the invention is to solve at least a part of the above-mentioned issues and can be realized in the following modes.

1. According to an aspect of the invention, there is provided a cover to be used for a liquid container that is attached to a liquid discharge apparatus and includes a first surface having a wall surrounding a communication port and a liquid supply portion which communicates with a liquid accommodation portion and supplies liquid to the liquid discharge apparatus, a second surface which intersects with the first surface, a third surface which intersects with the first surface and is opposed to the second surface and on which an air hole communicating with the communication port and at least one of protrusion and a recess. The cover includes a covering portion that covers the wall in a state where the cover is attached to the liquid container and a first cover portion that covers at least one of the protrusion and the recess in the state where the cover is attached to the liquid container. With the cover according to the aspect of the invention, the covering portion can cover the surrounding wall portion having the liquid supply portion, thereby suppressing leakage of the liquid to the outside from the surrounding wall portion (liquid supply portion). In addition, the cover includes an abutment portion that is contact with the protrusion formed on the third surface. Therefore, even when the liquid leaks from the air hole and flows along the third surface, the liquid can be held back on the contact portion between the protrusion and the abutment portion. Accordingly, spreading of the liquid leaked from the air hole on the third surface can be suppressed.

2. In the cover according to the above-mentioned aspect of the invention, it is preferable that the liquid container further include a detection member to be used for detecting an amount of liquid in the liquid accommodation portion or presence/absence of the liquid in the liquid accommodation portion optically, the detection member include an exposed portion exposed on the first surface, the first surface include a projecting portion which projects along a perpendicular direction of the first surface a greater extent than the exposed portion and is located between the liquid supply portion and the exposed portion, and the cover include a second cover portion that makes contact with the projecting portion in the state where the cover is attached to the liquid container. With the cover according to the aspect of the invention, the projecting portion which projects along the perpendicular direction of the first surface a greater extent than the exposed portion is arranged between the liquid supply portion and the exposed portion. Therefore, even when the liquid leaks from the liquid supply portion (surrounding wall portion) and flows along the first surface, the liquid can be held back by the projecting portion. Accordingly, the liquid can be suppressed from reaching the exposed portion, thereby suppressing false detection of the amount of the liquid or the presence/absence of the liquid due to adherence of the liquid to the exposed portion.

3. In the cover according to the above-mentioned aspect of the invention, it is preferable that the liquid container further include a fourth surface that intersects with the first surface, the second surface, and the third surface and has a container-side engagement portion which is engaged with the liquid discharge apparatus when the liquid container is attached to the liquid discharge apparatus, a fifth surface that is opposed to the fourth surface, and a detection member that has an exposed portion exposed on the first surface and is used for detecting an amount of liquid in the liquid accommodation portion or presence/absence of the liquid in the liquid accommodation portion optically, the air hole and the exposed portion be arranged at positions closer to a intersecting edge portion between the third surface and the fifth surface rather than to a intersecting edge portion between the third surface and the fourth surface, the exposed portion be located at a lower position in the vertical direction relative to the air hole in a state where the liquid container is attached to the liquid discharge apparatus, the cover include a cover-side engagement portion which is engaged with the container-side engagement portion in a state where the cover is attached to the liquid container, a virtual line passing through the cover-side engagement portion and extending in the direction toward the third surface from the second surface be a rotational center about which the cover and the liquid container are moved rotationally relative to each other when the cover is detached from the liquid container. With the cover according to the aspect of the invention, the air hole and the exposed portion are arranged at positions closer to the intersecting edge portion between the third surface and the fifth surface rather than to the intersecting edge portion between the third surface and the fourth surface. The cover and the liquid container are moved rotationally relative to each other about the virtual line of which the rotational center passing through the cover-side engagement portion and extending in the direction toward the third surface from the second surface when the cover is detached from the liquid container. Further, the exposed portion of the detection member is located at the lower position in the vertical direction relative to the air hole in the state where the liquid container is attached to the liquid discharge apparatus. Accordingly, even if liquid leaks from the air hole when the cover is arranged at the lower position in the vertical direction and the liquid container is arranged at the upper portion in the vertical direction and the cover is detached from the liquid container while fixing the cover and moving the liquid container upward in the vertical direction, the leaked liquid is made to flow toward the fourth surface on which the rotational center is present so as to be distanced from the exposed portion on the first surface. This makes it possible to suppress the liquid leaked from the air hole from reaching the exposed portion when the cover has been detached from the liquid container completely and the liquid container is attached to the liquid discharge apparatus.

4. In the cover according to the above-mentioned aspect of the invention, it is preferable that the liquid container have a sixth surface that intersects with the second surface, the third surface, the fourth surface and the fifth surface and is opposed to the first surface, the container-side engagement portion be formed on the fourth surface so as to project in the direction toward the fourth surface from the fifth surface, and the cover-side engagement portion make contact with an edge portion of the container-side engagement portion at the six surface side in the state where the cover is attached to the liquid container. With the cover according to the aspect of the invention, the cover and the liquid container can be moved rotationally relative to each other about the virtual line as the rotational center passing through the edge portion of the container-side engagement portion at the six surface side and extending in the direction toward the third surface from the second surface when the cover is detached from the liquid container.

5. In the cover according to the above-mentioned aspect of the invention, it is preferable that the liquid container further include a six surface that intersects with the second surface, the third surface, the fourth surface and the fifth surface and is opposed to the first surface, the container-side engagement portion be formed in a recess form in the direction toward the fifth surface from the fourth surface, and the cover-side engagement portion make contact with an edge portion of the container-side engagement portion at the six surface side in the state where the cover is attached to the liquid container. With the cover according to the aspect of the invention, the cover and the liquid container can be moved rotationally relative to each other about the virtual line of which the rotational center passing through the edge portion of the container-side engagement portion at the six surface side and extending in the direction toward the third surface from the second surface when the cover is detached from the liquid container.

6. According to another aspect of the invention, there is provided a liquid container to which the cover is attached.

Not all the plurality of constituent components in the above-mentioned respective aspects of the invention are essential. A part of the plurality of constituent components can be changed, omitted, or replaced by another constituent component, or limited contents thereof can be omitted partially in order to solve a part or all of the above-mentioned issues or achieve a part or all of effects as will be described in the specification. Further, an independent aspect of the invention can be made by combining a part or all of technical characteristics included in the above-mentioned one aspect of the invention with a part or all of the technical characteristics included in the above-mentioned another aspect of the invention in order to solve a part or all of the above-mentioned issues or achieve a part or all of effects as will be described in the specification.

For example, one aspect of the invention can be realized as a device including equal to or more than one of two components of the covering portion and the first cover portion. That is to say, the device may or may not include the covering portion. Further, the device may or may not include the first cover portion. For example, the covering portion may be configured as a covering portion that covers the wall of the liquid container in the state where the cover is attached to the liquid container. In addition, the first cover portion may be configured as a first cover portion that covers at least one of the protrusion and the recess of the liquid container in the state where the cover is attached to the liquid container. The device can be realized as the cover, for example, and can be also realized as devices other than the cover. For example, the device can be also realized as a cap for a cartridge that accommodates liquid. With the aspect, at least one of various problems can be solved. For example, at least one of reduction in the size of the device (member), resource saving, making manufacturing easier, and improvement of usability can be achieved. Either a part or all of the technical characteristics in the cover according to the above-mentioned aspects can be applied to the device.

It is to be noted that the invention can be realized in various modes and can be realized in modes of a cartridge, a cover manufacturing method, a liquid container manufacturing method, a cartridge manufacturing method, and the like, for example.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention are described in the following order.

Embodiments

Variations

First Embodiment

1. Configuration of Liquid Ejecting System

Figure 1:
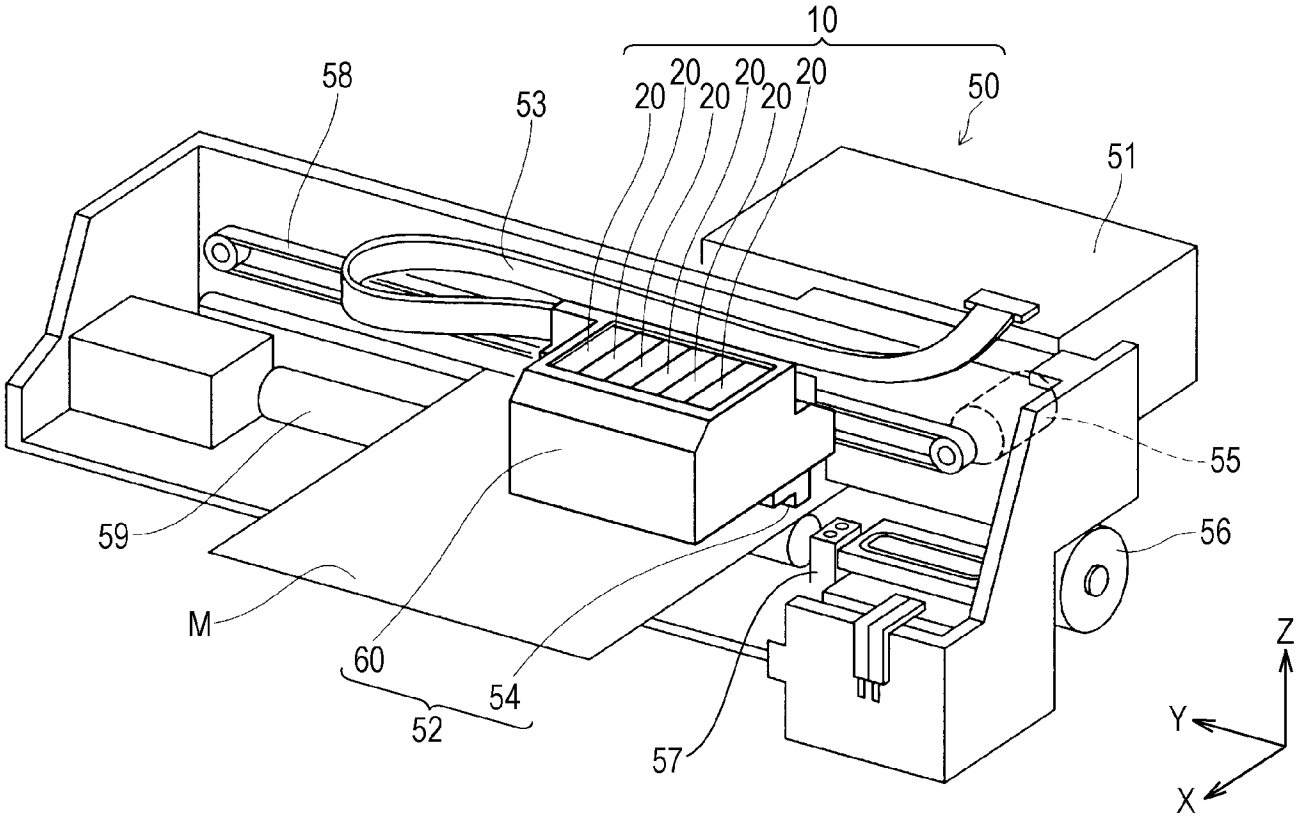
FIG. 1 is a perspective view illustrating a configuration of a liquid ejecting system.

FIG. 1 is a perspective view illustrating a configuration of a liquid ejecting system 10. In FIG. 1, XYZ axes orthogonal to one another are illustrated. The XYZ axes in FIG. 1 correspond to XYZ axes in other drawings. The XYZ axes are also depicted in subsequent drawings if necessary. The liquid ejecting system 10 includes cartridges 20 as liquid containers and a printer 50 as a liquid discharge apparatus. In the liquid ejecting system 10, a user attaches the cartridges 20 to a holder 60 of the printer 50 in a detachable manner.

Each cartridge 20 accommodates ink therein. The ink accommodated in the cartridge 20 is supplied to a head 54 through a liquid supply portion and a liquid supply tube, which will be described later. In the embodiment, a plurality of cartridges 20 are attached to the holder 60 of the printer 50 in the detachable manner. In the embodiment, six types of the cartridges 20 corresponding to inks of six colors (black, yellow, magenta, light magenta, cyan and light cyan), respectively, that is, six cartridges 20 in total are attached to the holder 60. It is to be noted that the number of cartridges 20 to be attached to the holder 60 are not limited to six.

The printer 50 is a small-sized ink jet printer for individuals. The printer 50 includes a controller 51, and a carriage 52 having the holder 60 in addition to the holder 60. The carriage 52 includes the head 54. The printer 50 flows ink to the head 54 from the cartridges 20 attached to the holder 60 through the liquid supply tubes, which will be described later. The head 54 includes a discharge mechanism such as piezoelectric elements and discharges (supplies) ink to a print medium 90 such as a sheet or a label. With this, data of a character, a figure, an image, and the like are printed on the print medium 90.

The controller 51 controls the respective parts of the printer 50. The carriage 52 of the printer 50 is configured so as to move the head 54 relative to the print medium 90. The controller 51 and the carriage 52 are electrically connected through a flexible cable 53 and the discharge mechanism of the head 54 operates based on a control signal from the controller 51.

In the embodiment, the holder 60 is held on the carriage 52 together with the head 54. A type of the printer 50 in which the cartridges 20 are attached to the holder 60 on the carriage 52 for moving the head 54 as described above is also referred to as "on-carriage type". In other embodiments, the unmovable holder 60 may be held on a portion different from the carriage 52 and ink may be supplied to the head 54 from the cartridges 20 attached to the holder 60 through tubes. A type of such a printer is also referred to as "off-carriage type".

In the embodiment, the printer 50 includes a main-scanning feeding mechanism and a sub-scanning feeding mechanism that move the carriage 52 and the print medium 90 relatively so as to realize printing on the print medium 90. The main-scanning feeding mechanism of the printer 50 includes a carriage motor 55 and a driving belt 58. A driving force of the carriage motor 55 is transmitted to the carriage 52 through the driving belt 58 so that the carriage 52 is made to reciprocate in the main-scanning direction. The sub-scanning feeding mechanism of the printer 50 includes a transportation motor 56 and a platen 59. A driving force of the transportation motor 56 is transmitted to the platen 59 so that the print medium 90 is transported in the sub-scanning direction orthogonal to the main-scanning direction.

A detector 57 for detecting a residual amount of ink in the cartridges 20 optically is provided on the printer 50 at the outer side of a printing region. A light emitting portion and a light receiving portion are provided in the detector 57. When the cartridges 20 pass through the upper side of the detector 57 with the movement of the carriage 52, the controller 51 controls the light emitting portion of the detector 57 to emit light and detect ink residual amount states (to be more specific, presence/absence of ink) in the cartridges 20 based on whether or not the light receiving portion of the detector 57 receives the light.

In the embodiment, in a usage state (also referred to as "usage orientation") of the liquid ejecting system 10, the axis along the sub-scanning direction (front-rear direction) in which the print medium 90 is transported is set to the X-axis, the axis along the main-scanning direction (right-left direction) in which the carriage 52 is made to reciprocate is set to the Y-axis, and the axis along the gravity force direction (up-down direction) is set to the Z-axis. It is to be noted that the usage state of the liquid ejecting system 10 indicates the state of the liquid ejecting system 10 installed on a horizontal plane, and the horizontal plane corresponds to the plane (XY plane) in parallel with the X-axis and the Y-axis in the embodiment.

In the embodiment, the sub-scanning direction (forward direction) is set to the +X-axis direction and the inverse direction thereof (backward direction) is set to the −X-axis direction. Further, the direction (upward direction) toward the upper side from the lower side in the gravity force direction is set to the +Z-axis direction and the inverse direction thereof (downward direction) is set to the −Z-axis direction. In the embodiment, the direction toward the left side surface from the right side surface of the liquid ejecting system 10 is set to the +Y-axis direction (leftward direction) and the inverse direction thereof is set to the −Y-axis direction (rightward direction). In the embodiment, the alignment direction of the plurality of cartridges 20 attached to the holder 60 is the direction along the Y-axis (right-left direction, also referred to as "Y-axis direction" simply). It is to be noted that the direction along the X-axis (front-rear direction) is also referred to as "X-axis direction" and the direction along the Z-axis (up-down direction) is also referred to as "Z-axis direction".

2. Configuration of Holder 60

Figure 2:
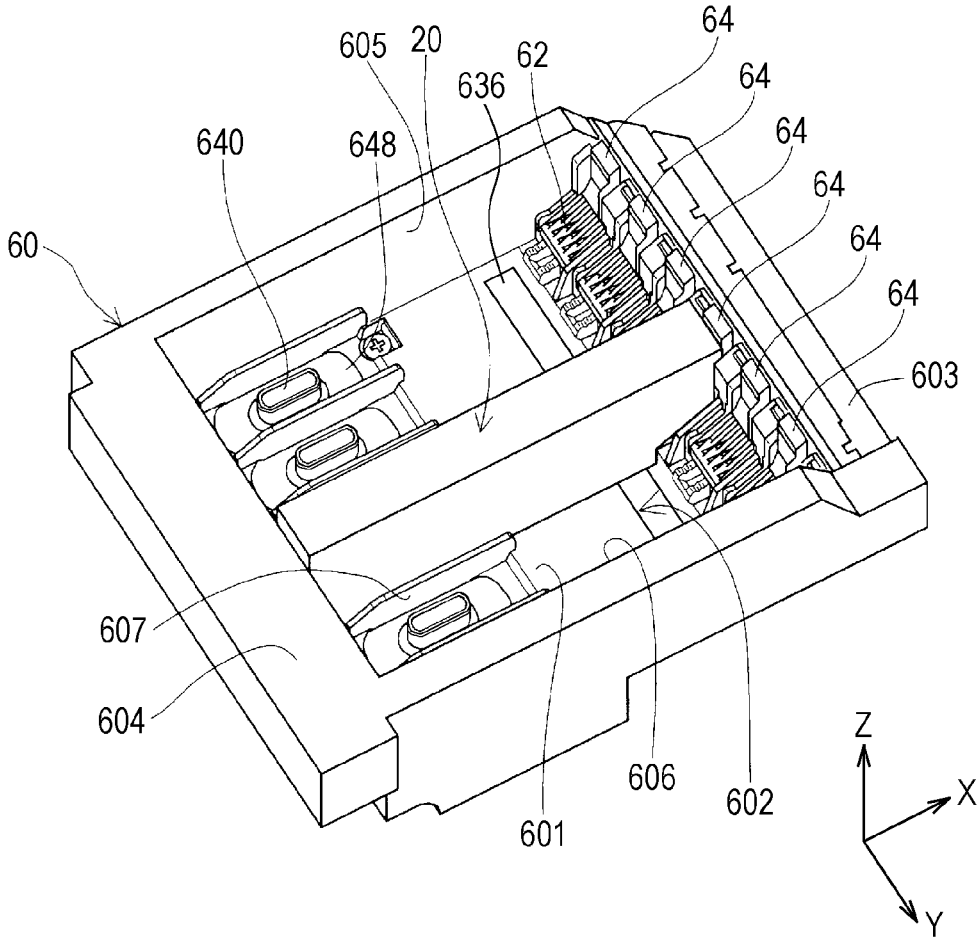
FIG. 2 is a first perspective view illustrating a holder according to a first embodiment to which a cartridge is attached.
Figure 3:
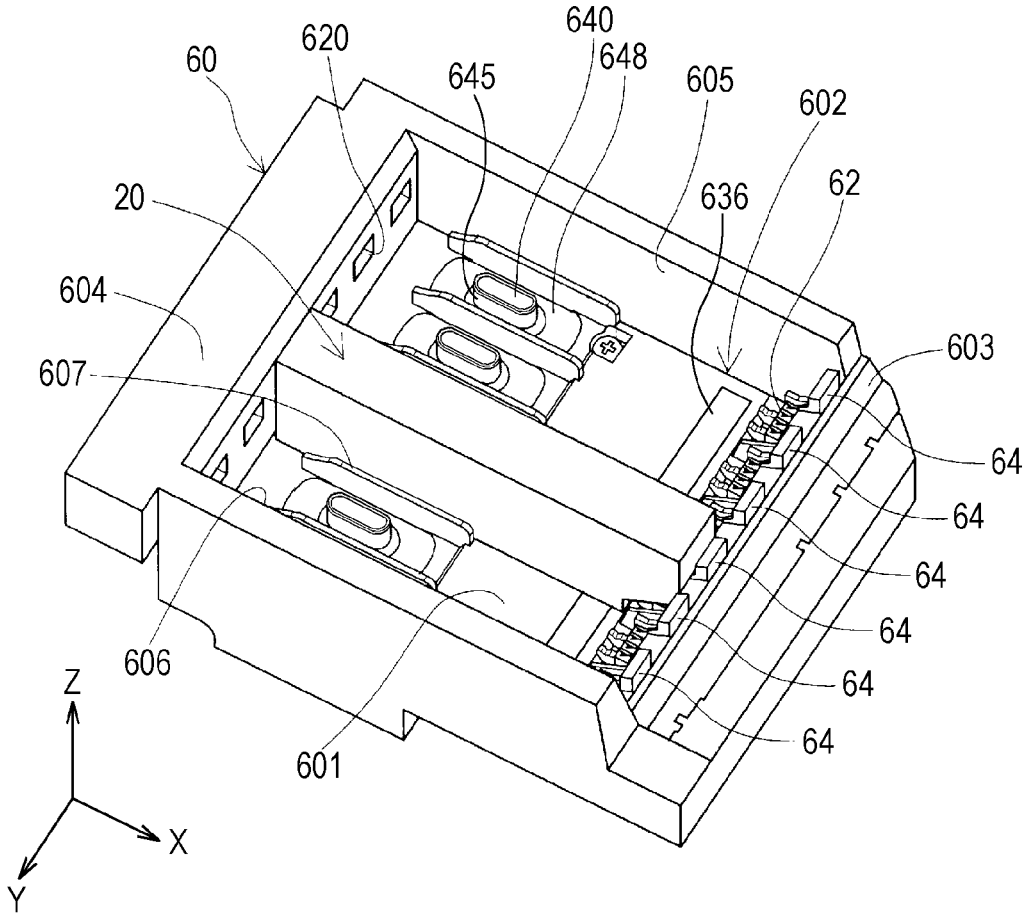
FIG. 3 is a second perspective view illustrating the holder according to the first embodiment to which the cartridge is attached.

FIG. 2 is a first perspective view illustrating the holder 60 according to the first embodiment to which the cartridge 20 is attached. FIG. 3 is a second perspective view illustrating the holder 60 according to the first embodiment to which the cartridge 20 is attached. The holder 60 according to the first embodiment includes five wall portions 601, 603, 604, 605 and 606. Four wall portions 603, 604, 605 and 606 extend in the +Z-axis direction from peripheral edge portions of the wall portion 601 so as to form a recess. The recess corresponds to a cartridge accommodation chamber 602 (also referred to as "cartridge attachment portion 602") that accommodates the cartridges 20. Further, the cartridge accommodation chamber 602 is partitioned into a plurality of slots (attachment spaces) that can receive the respective cartridges 20 by partitioning walls 607. The partitioning walls 607 function as guides when the cartridges 20 are inserted into the slots but can be omitted in some cases. Further, a through-hole 636 is formed on the wall portion 601 such that light can pass through the through-hole 636 in order to detect the ink residual amount states optically by using the detector 57.

The holder 60 includes a liquid supply tube 640, a lever 64, a contact point mechanism 62 and a locking hole 620 for each slot. One side surface (side surface in the +Z-axis direction, upper surface) of each slot is opened and each cartridge 20 is attached to and detached from the holder 60 through the opened one side surface (upper surface).

The liquid supply tube 640 forms a flow path for flowing the ink in the cartridge 20 to the head 54. The liquid supply tube 640 is connected to the liquid supply portion of the cartridge 20 in a state (attached state) where the cartridge 20 is attached to the printer 50. An elastic member 648 is provided around the liquid supply tube 640. The elastic member 648 seals the surrounding of the liquid supply portion of the cartridge 20 in the attached state. This prevents ink from leaking to the surrounding from the liquid supply portion of the cartridge 20.

The lever 64 is used when the cartridge 20 is attached and detached. Further, the lever 64 locks the cartridge 20 in the state (attached state) where the cartridge 20 is attached to the holder 60.

The contact point mechanism 62 is electrically connected to a circuit substrate, which will be described later, of the cartridge 20 in the attached state. Further, the contact point mechanism 62 is electrically connected to the controller 51. With this, various pieces of information (ink color and ink residual amount state of the cartridge 20) are transmitted between the cartridge 20 and the printer 50.

The locking hole 620 is a through-hole that penetrates through the wall portion 604 in the thickness direction. A second locking portion of the cartridge 20, which will be described later, is inserted into the locking hole 620 in the state where the cartridge 20 is attached to the holder 60.

3. Outer Appearance Configuration of Cartridge 20

Figure 4:
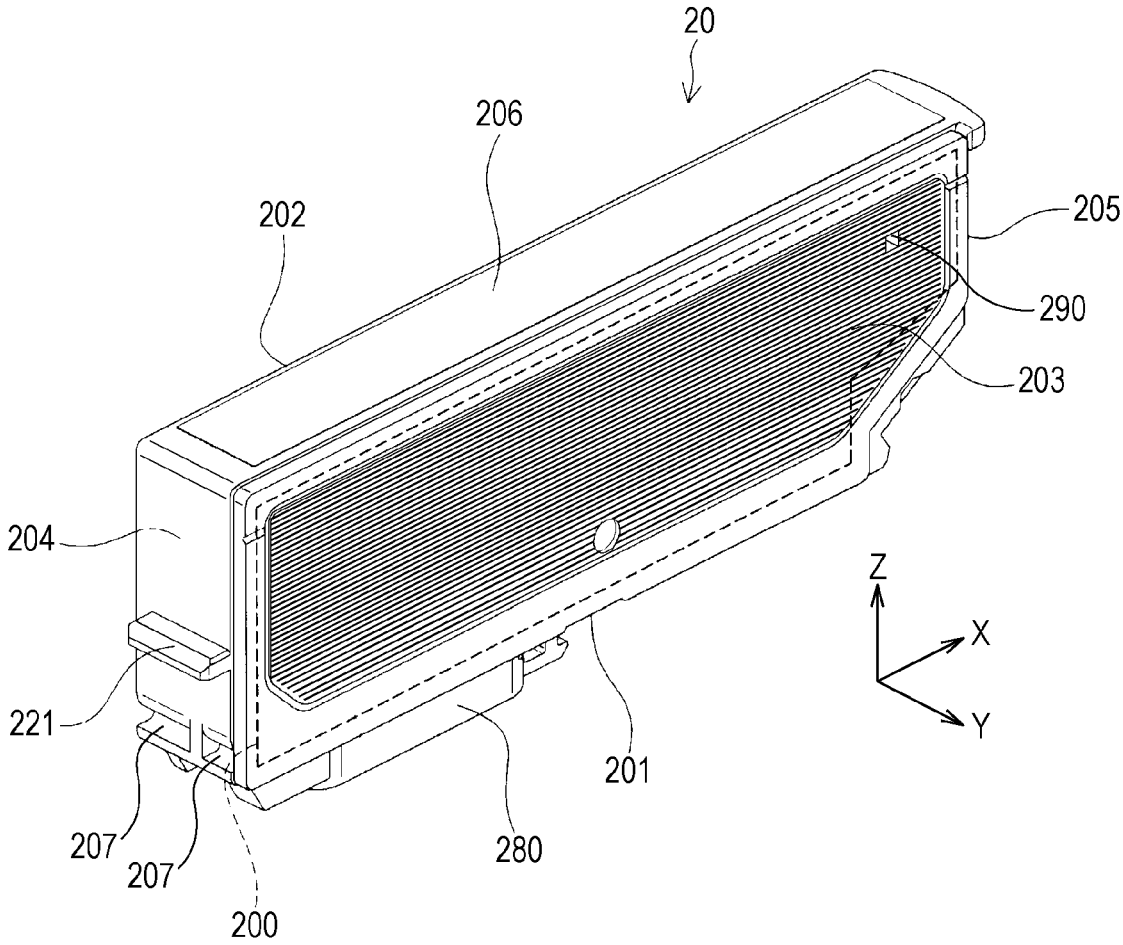
FIG. 4 is a first outer appearance perspective view of the cartridge.
Figure 5:
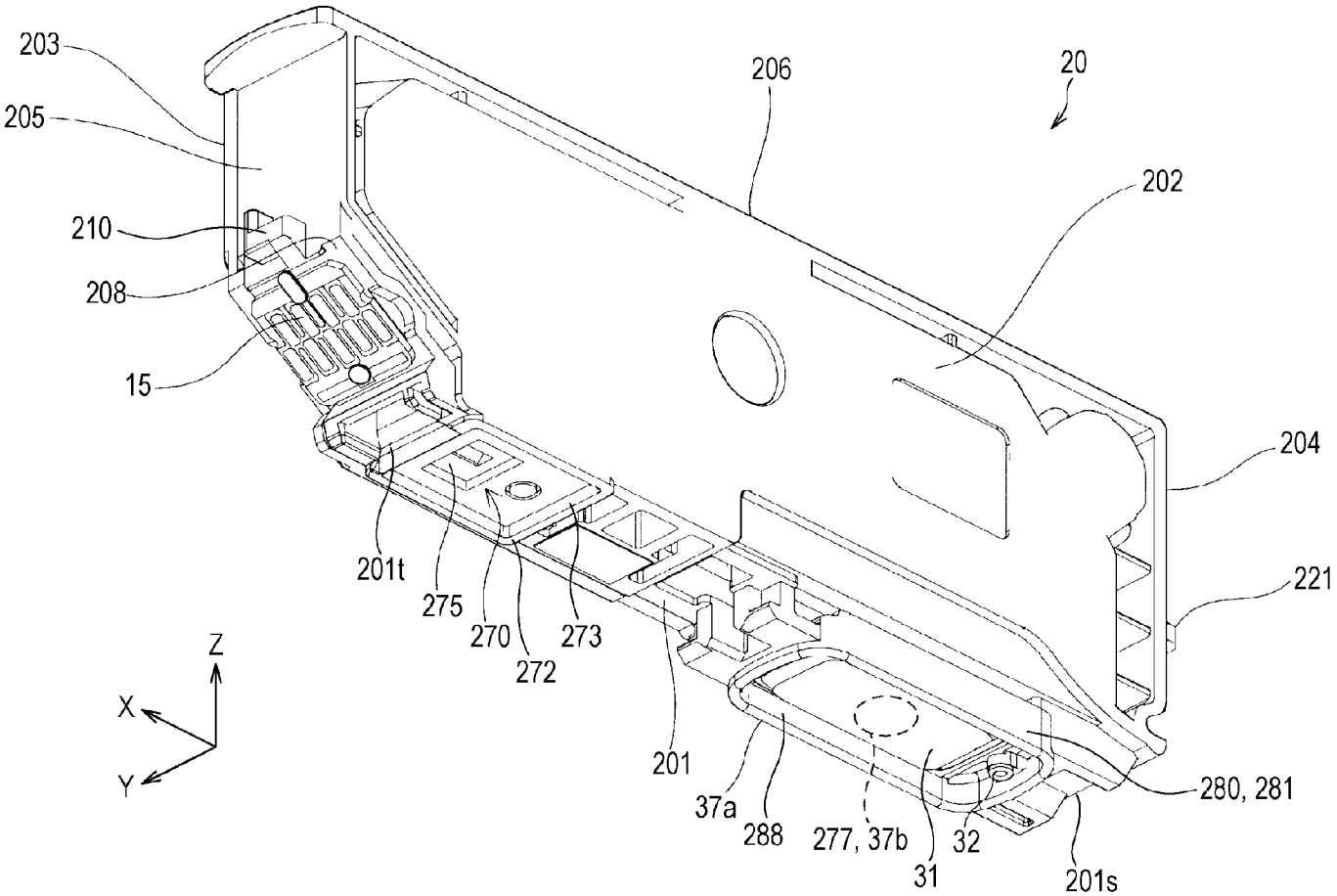
FIG. 5 is a second outer appearance perspective view of the cartridge.
Figure 6:
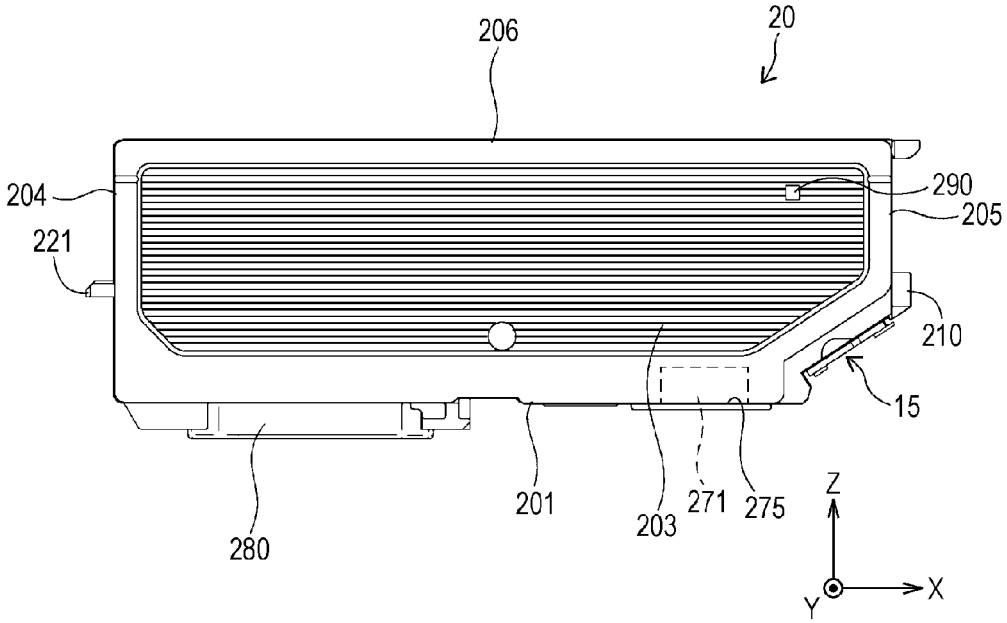
FIG. 6 is a front view of the cartridge.
Figure 7:
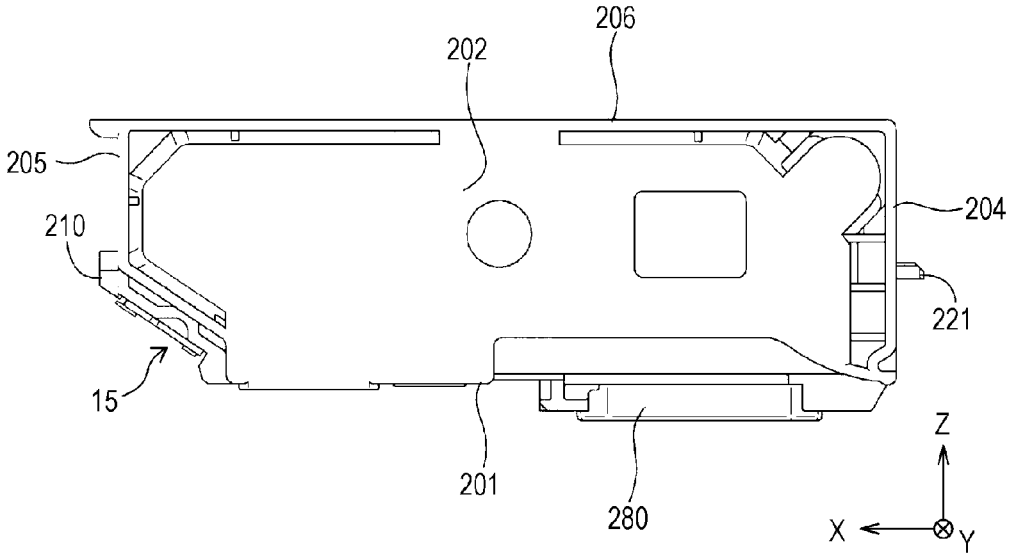
FIG. 7 is a rear view of the cartridge.
Figure 8:
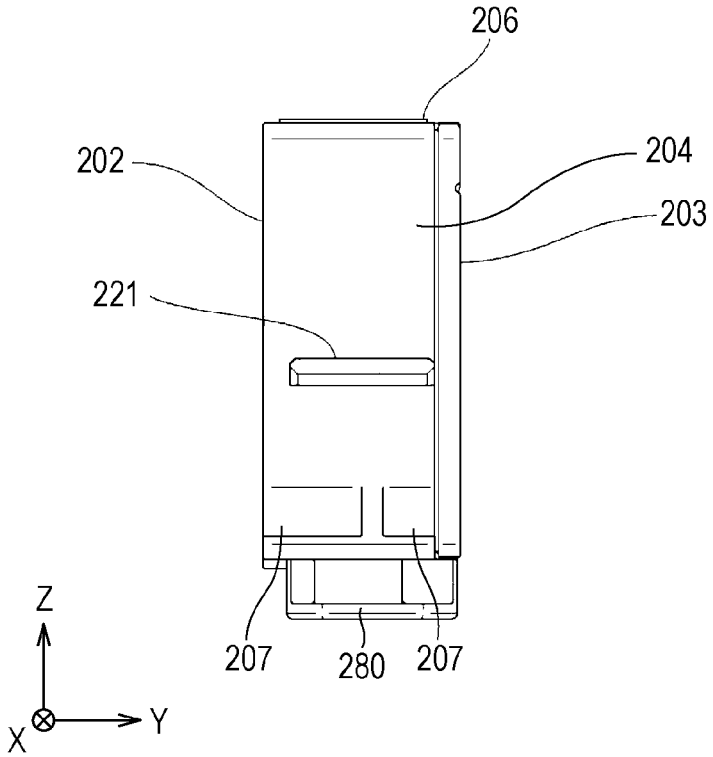
FIG. 8 is a left side view of the cartridge.
Figure 9:
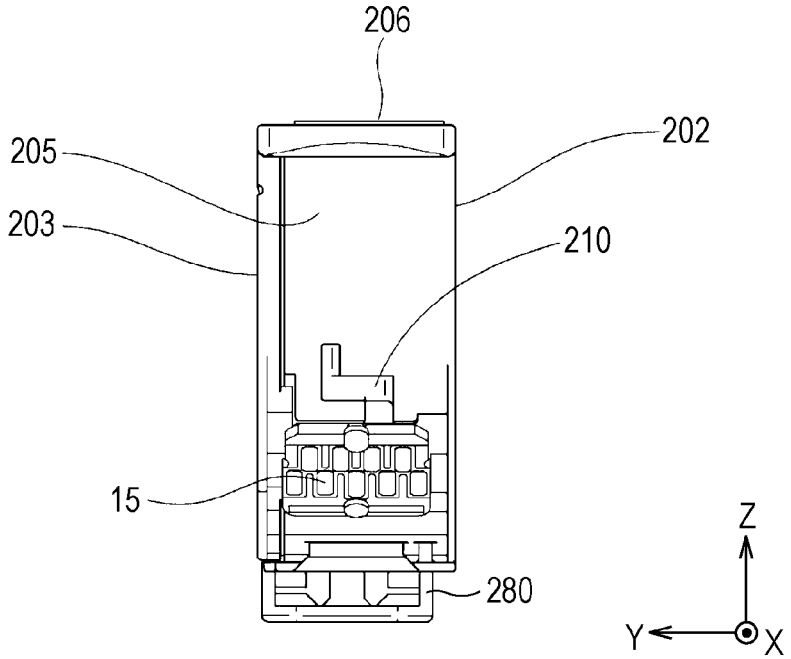
FIG. 9 is a right side view of the cartridge.
Figure 10:
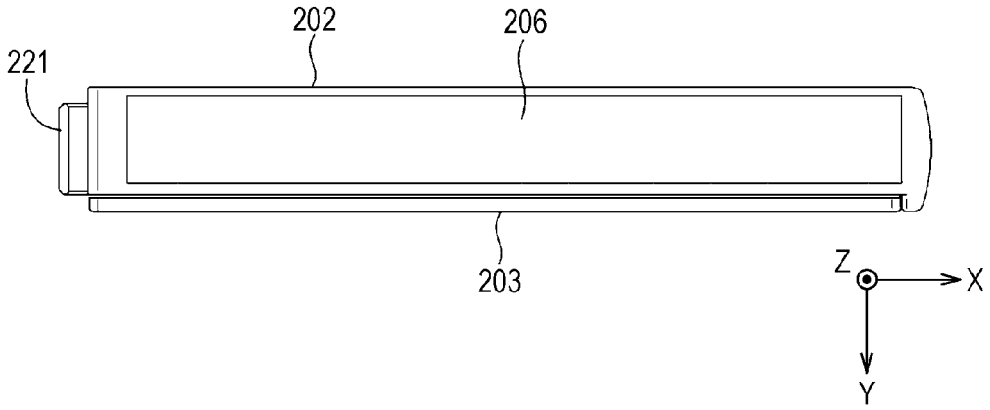
FIG. 10 is a plan view of the cartridge.
Figure 11:
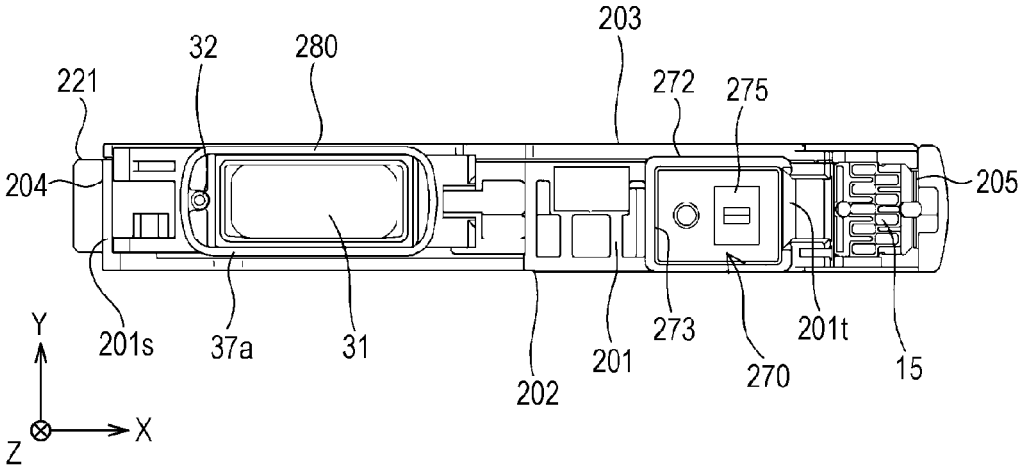
FIG. 11 is a bottom view of the cartridge.

FIG. 4 is a first outer appearance perspective view of the cartridge 20. FIG. 5 is a second outer appearance perspective view of the cartridge 20. FIG. 6 is a front view of the cartridge 20. FIG. 7 is a rear view of the cartridge 20. FIG. 8 is a left side view of the cartridge 20. FIG. 9 is a right side view of the cartridge 20. FIG. 10 is a plan view of the cartridge 20. FIG. 11 is a bottom view of the cartridge 20. The cartridge 20 according to the embodiment is a what-is-called semi-sealed cartridge 20 in which the outside air is introduced into a liquid accommodation portion 200 intermittently with ink consumption. It is to be noted that the inner configuration of the cartridge 20 will be described later.

As illustrated in FIG. 4, the cartridge 20 includes the liquid accommodation portion 200 for accommodating ink therein and a liquid supply portion 280 for distributing the ink in the liquid accommodation portion 200 to the external printer 50.

As illustrated in FIG. 4 to FIG. 11, the cartridge 20 has an outer shape of approximate rectangular parallelepiped. The cartridge 20 includes six surfaces (walls) 201 to 206. The six surfaces 201 to 206 constitute an outer surface (outer case) of the cartridge 20. The six surfaces are constituted by the first surface 201, the second surface 202, the third surface 203, the fourth surface 204, the fifth surface 205, and the sixth surface 206. The respective surfaces 201 to 206 are substantially flat surfaces. The expression "substantially flat surface" includes a case where the overall surface is flat completely and a case where irregularities are formed on a part of the surface. That is to say, the expression "substantially flat surfaces" includes a case where the surfaces and walls constituting the outer case of the cartridge 20 can be recognized even if the irregularities are formed on a part of the surfaces. Any of the outer shapes of the first surface to sixth surface 201 to 206 when seen from the above are rectangular.

The first surface 201 and the sixth surface 206 are opposed to each other. The fifth surface 205 and the fourth surface 204 are opposed to each other. The third surface 203 and the second surface 202 are opposed to each other. The direction in which the first surface 201 and the sixth surface 206 are opposed to each other corresponds to the Z-axis direction (direction along the first direction). The direction in which the fifth surface 205 and the fourth surface 204 are opposed to each other corresponds to the X-axis direction. The direction in which the third surface 203 and the second surface 202 are opposed to each other corresponds to the Y-axis direction. In the embodiment, the first surface 201 constitutes the bottom surface in the state where the cartridge 20 is attached to the printer 50. As illustrated in FIG. 11, the edge portion (side) of the first surface 201 at the fifth surface 205 side is also referred to as a first edge portion 201*t*. Further, the edge portion (side) of the first surface 201 at the fourth surface 204 side is also referred to as a second edge portion 201*s*. In addition, the −Z-axis direction (first direction) corresponds to the downward direction in the vertical direction in the state where the cartridge 20 is attached to the printer 50.

The fifth surface 205 intersects with the first surface 201. The fourth surface 204 intersects with the first surface 201. The sixth surface 206 intersects with the fourth surface 204 and the fifth surface 205. The third surface 203 intersects with the first surface 201, the sixth surface 206, the fourth surface 204 and the fifth surface 205. The second surface 202 intersects with the first surface 201, the sixth surface 206, the fourth surface 204 and the fifth surface 205. The state where two surfaces "intersect" indicates any one of the state where two surfaces intersect with each other actually, the state where a virtual extended surface of one surface intersects with the other surface, and the state where virtual extended surfaces of the two surfaces intersect with each other.

As illustrated in FIG. 4 and FIG. 5, the liquid supply portion 280 is provided so as to project from the first surface 201. To be more specific, the liquid supply portion 280 extends along the −Z-axis direction (first direction) from the first surface 201. The liquid supply portion 280 is connected to the printer 50. As illustrated in FIG. 5, the liquid supply portion 280 has a surrounding wall portion 281 as a wall surrounding the periphery of the liquid supply portion 280. One edge portion 37*b* provided in the surrounding wall portion 281 has a liquid communication port 277 so that the liquid supply portion 280 communicates with the liquid accommodation portion 200. The other edge portion 37*a* corresponding to the edge portion of the surrounding wall portion 281 forms an opening. Note that the other edge portion 37*a* is located at the −Z-axis direction side (first direction side) relative to the one edge portion 37*b*. Further, the liquid supply portion 280 has a flow path for flowing ink in the direction (Z-axis direction) along the first direction. The above-mentioned liquid supply portion 280 will be described below from another viewpoint. That is to say, the liquid supply portion 280 projects outward from the member (first surface) constituting the cartridge 20. Further, an opening 288 is formed on the other edge portion 37*a* as one end of the liquid supply portion 280. The projecting direction of the liquid supply portion 280 corresponds to the −Z-axis direction. The liquid supply tube 640 of the printer 50 is inserted into the liquid supply portion 280 through the opening 288. As illustrated in FIG. 4, a number of grooves extending in the X-axis direction (direction toward the fifth surface 205 from the fourth surface 204) are formed on the third surface 203. Further, an air introduction port 290 for introducing the air into the cartridge 20 is formed on the third surface 203. The air introduction port 290 is arranged on the third surface 203 at a position closer to the edge portion on which the third surface 203 and the fifth surface 205 intersect with each other rather than to the edge portion on which the third surface 203 and the fourth surface 204 intersect with each other.

As illustrated in FIG. 5 and FIG. 11, a liquid flow-out portion 31 and a communication port 32 are formed in the liquid supply portion 280. Ink is flowed in the liquid flow-out portion 31 toward the liquid supply tube 640 of the printer 50. The communication port 32 makes the inside and the outside of the liquid supply portion 280 communicate with each other. That is to say, the communication port 32 is an opening for connecting the inside and the outside of the liquid supply portion 280. The liquid flow-out portion 31 is configured so as to hold ink. In the attached state, the liquid supply tube 640 (FIG. 2, FIG. 3) is inserted into the liquid supply portion 280 through the opening 288 as the liquid supply port so that ink can flow to the liquid supply tube 640 from the liquid supply portion 280. Note that a flow path from the inner portion of the liquid accommodation portion 200 to the liquid flow-out portion 31 is filled with ink in the unused state before the cartridge 20 is used in the printer 50. Further, the cartridge 20 has a communication path for communicating the inside and the outside of the liquid supply portion 280. One end of the communication path corresponds to the communication port 32 and the other end thereof corresponds to the air introduction port 290 (FIG. 4) formed on the third surface 203. It is to be noted that details of the communication path will be described later. The liquid flow-out portion 31 is contact with the liquid supply tube 640 for flowing ink to the head 54 in the attached state.

As illustrated in FIG. 5 and FIG. 11, a prism unit 270 is arranged on the first surface 201 so as to form a part of the first surface 201. The prism unit 270 includes a what-is-called right angle prism. The right angle prism of the prism unit 270 is located in the liquid accommodation portion 200. As illustrated in FIG. 5 to FIG. 7 and FIG. 11, the prism unit 270 includes a transmitting surface 275 as a transmitting portion that forms a part of the first surface 201 and two surfaces (reflection surfaces) 271 (FIG. 6) substantially intersecting with each other perpendicularly. Light output from the detector 57 (FIG. 1) penetrates through the transmitting surface 275. Further, light toward the detector 57 that has reflected by the surfaces 271 penetrates through the transmitting surface 275. As illustrated in FIG. 11, the transmitting surface 275 is arranged on the first surface 201 at the side closer to the first edge portion 201*t* rather than to the second edge portion 201*s*. On the other hand, the liquid supply portion 280 is arranged on the first surface 201 at the side closer to the second edge portion 201*s* rather than to the first edge portion 201*t*. To be more specific, the transmitting surface 275 is closer to the first edge portion 201*t* and the liquid supply portion 280 is closer to the second edge portion 201*s* in order to keep the transmitting surface 275 and the liquid supply portion 280 as far as possible from each other. The transmitting surface 275 is arranged on the first surface 201 at a position closer to the edge portion on which the third surface 203 and the fifth surface 205 intersect with each other rather than to the edge portion on which the third surface 203 and the fourth surface 204 intersect with each other.

As illustrated in FIG. 5 and FIG. 11, a wall portion 272 is formed on the first surface 201 on the periphery of the prism unit 270 (transmitting surface 275). The wall portion 272 is provided so as to project outward (in the direction toward the first surface from the sixth surface) from the first surface 201. The wall portion 272 is arranged so as to surround the transmitting surface 275. As illustrated in FIG. 11, a separation wall portion 273 of the wall portion 272, as a portion at the fourth surface 204 side, is located between the liquid supply portion 280 and the prism unit 270 (transmitting surface 275) on the first surface 201.

As illustrated in FIG. 5, a protruding first locking portion 210 is formed on the fifth surface 205. The first locking portion 210 is locked to the lever 64 in the attached state. As illustrated in FIG. 4, a protruding second locking portion 221 is formed on the fourth surface 204. The second locking portion 221 is inserted into the locking hole 620 as illustrated in FIG. 2 so as to be locked in the state where the cartridge 20 is attached to the holder 60. Further, the second locking portion 221 is used for being engaged with a cap, which will be described later, in a state where the cap is attached to the cartridge 20.

As illustrated in FIG. 4 and FIG. 8, a pair of recesses 207 are formed on the fourth surface 204 at a position closer to the edge portion of the first surface 201. The respective recesses 207 are formed as grooves formed along the direction toward the fifth surface 205 from the fourth surface 204 while being opened at the fourth surface 204 side. The pair of recesses 207 are arranged at a predetermined interval in the Y-axis direction.

As illustrated in FIG. 5, a circuit substrate 15 is provided on a connecting surface 208 that connects the first surface 201 and the fifth surface 205. A plurality of terminals that are contact with the contact point mechanism 62 in the attached state are formed on the surface of the circuit substrate 15. Further, a storage device that stores various pieces of information (ink residual amount state, ink color, and the like) of the cartridge 20 is provided on the rear surface of the circuit substrate 15.

As illustrated in FIG. 5 and FIG. 7, a thinned portion is formed on the second surface 202. The thinned portion is a recessed site (recess) formed in the direction toward the third surface 203 from the second surface 202. If the thickness of the outer case of the cartridge 20 (main body member 22 which will be described later) is large, there arises risks that air bubbles (voids) are generated in the member and the member is deflected. The generation of air bubbles and the generation of deflection are suppressed by forming the thinned portion and making the thickness of the main body member 22 smaller (thinner) partially in the cartridge 20.

4. Inner Configuration of Cartridge 20

Figure 12:
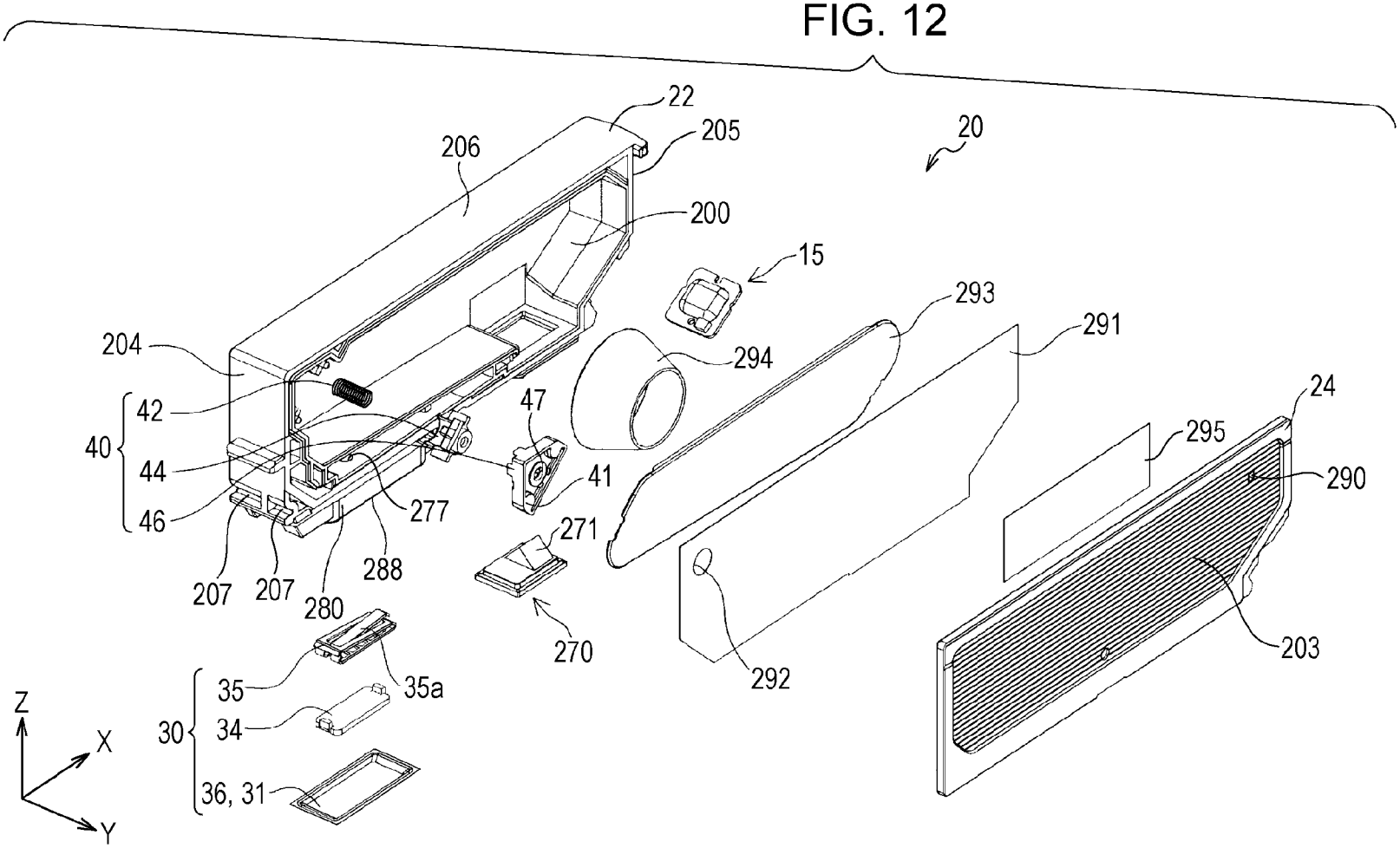
FIG. 12 is an exploded perspective view of the cartridge.
Figure 13:
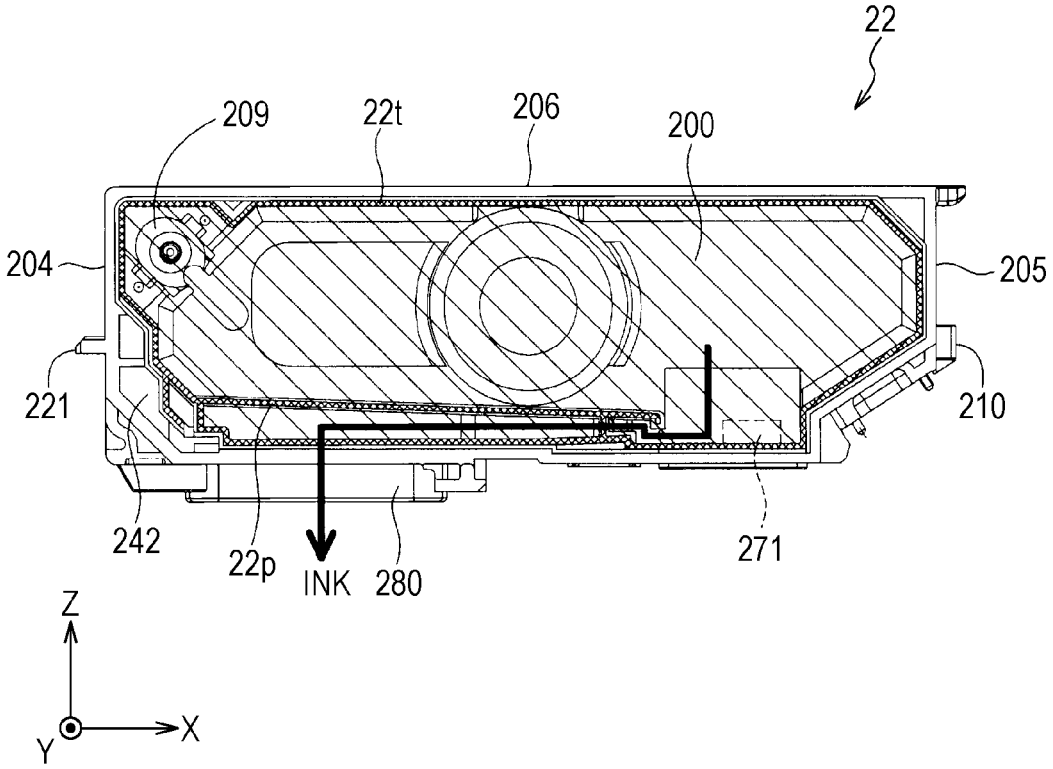
FIG. 13 is a front view illustrating a main body member.

FIG. 12 is an exploded perspective view of the cartridge 20. FIG. 13 is a front view of the main body member 22. It is to be noted that the surfaces 271 of the prism unit 270 are illustrated by a dashed line in FIG. 13. Further, a state where ink in the liquid accommodation portion 200 flows to the outside through the liquid supply portion 280 is indicated by an arrow in FIG. 13. As illustrated in FIG. 12, the cartridge 20 includes the main body member 22 and a lid member 24. The main body member 22 and the lid member 24 form the outer surface (outer case) of the cartridge 20. Further, the cartridge 20 includes a valve mechanism 40, a coil spring 294 as a biasing member, a pressure receiving plate 293 and a sheet member (film member) 291.

The main body member 22 and the lid member 24 are made of a synthetic resin such as polypropylene. Further, the sheet member 291 is made of a synthetic resin (for example, material containing nylon and polypropylene) and has flexibility. That is to say, the sheet member 291 is configured so as to be deformed with an external force.

A ventilation port 292 is formed on the sheet member 291. With this, the cartridge 20 can take the air into the liquid accommodation portion 200 through the air introduction port 290, the ventilation port 292, and a through-hole 47 (which will be described later).

The main body member 22 is a member for forming the liquid accommodation portion 200 and the liquid supply portion 280. The main body member 22 has a recessed shape and one side surface thereof is opened. The sheet member 291 is bonded to the main body member 22 so as to cover the opening on one side surface of the main body member 22. To be more specific, as illustrated in FIG. 13, the sheet member 291 is bonded to an end surface 22*t* forming the opening of the main body member 22 and an end surface 22*p* of a rib in the liquid accommodation portion 200 hermetically. With this, the liquid accommodation portion 200 for accommodating ink is formed. That is to say, the liquid accommodation portion 200 is formed by the sheet member 291 of which part of the wall portion partitioning the inner space can be deformed. This enables the volume of the liquid accommodation portion 200 to be changed. In FIG. 13, a portion to which the sheet member 291 is bonded is indicated by cross hatching and a portion on which the liquid accommodation portion 200 is formed is indicated by single hatching for being understood easily.

As illustrated in FIG. 13, the lid member 24 is attached to the end surface of the main body member 22 at the +Y-axis direction side by thermal welding or the like. To be more specific, the lid member 24 is attached to the end surface of the main body member 22 on the outer region relative to the region on which the sheet member 291 is bonded. Further, a first communication chamber 242 as a part of the communication path for communicating the inside and the outside of the liquid supply portion 280 is formed on the main body member 22 at the outer side relative to the region on which the liquid accommodation portion 200 is formed.

A space is formed between the sheet member 291 and the lid member 24. The space forms a part of the communication path for communicating the inside and the outside of the liquid supply portion 280.

The pressure receiving plate 293 is made of a synthetic resin such as polypropylene. The pressure receiving plate 293 is arranged to be contact with the sheet member 291. The coil spring 294 is arranged in the liquid accommodation portion 200. To be more specific, the coil spring 294 abuts against the pressure receiving plate 293 and the surface (opposed surface) of the main body member 22 that is opposed to the pressure receiving plate 293. The coil spring 294 biases the pressure receiving plate 293 in the direction of increasing the volume of the liquid accommodation portion 200. The coil spring 294 expands and contracts (moves) along the Y-axis direction.

The valve mechanism 40 is a mechanism for introducing the air to the liquid accommodation portion 200 intermittently with the consumption of ink in the liquid accommodation portion 200. As illustrated in FIG. 12, the valve mechanism 40 includes a spring member 42, a lever valve 44, and a cover valve 46. The cover valve 46 is accommodated in a corner portion 209 (FIG. 13) of the main body member 22 on which the fourth surface 204 and the sixth surface 206 intersect with each other and is attached to the main body member 22. The cover valve 46 is made of a synthetic resin such as polypropylene, for example. The cover valve 46 has a recessed shape and the sheet member 291 is bonded to the end surface 41 forming the opening hermetically. The recess on the cover valve 46 communicates with the ventilation port 292. Further, the through-hole 47 that penetrates through the cover valve 46 to the rear side thereof is formed on the bottom portion of the recess of the cover valve 46.

The lever valve 44 is pressed against the cover valve 46 by the spring member 42 so as to close the through-hole 47. The lever valve 44 has a portion that abuts against the pressure receiving plate 293 if the pressure receiving plate 293 is deformed. The lever valve 44 may be made of a synthetic resin such as polypropylene, for example. Alternatively, the lever valve 44 may be formed by two-color molding by using an elastic member such as an elastomer and the synthetic resin such as polypropylene.

The liquid supply portion 280 communicates with the liquid accommodation portion 200. As illustrated in FIG. 12, the liquid supply portion 280 includes a supply member 30 therein. The supply member 30 includes a pressure member 35, a foam (porous member) 34 and a sheet member (filter member) 36. The pressure member 35, the foam 34 and the sheet member 36 are arranged in this order toward the other edge portion 37*a* from the one edge portion 37*b* of the liquid supply portion 280. The pressure member 35 is made of metal, for example. The pressure member 35 has a spring portion 35*a* and biases (presses) the foam 34 downward (in the −Z-axis direction) by using the spring portion 35*a*. The foam 34 and the sheet member 36 are made of a synthetic resin such as polyethylene terephthalate, for example. The sheet member 36 is contact with the liquid supply tube 640 (FIG. 2) in the attached state and flows ink to the printer 50. That is to say, the sheet member 36 forms the liquid flow-out portion 31.

5. Operations of Communication Path and Cartridge 20

Figure 14:
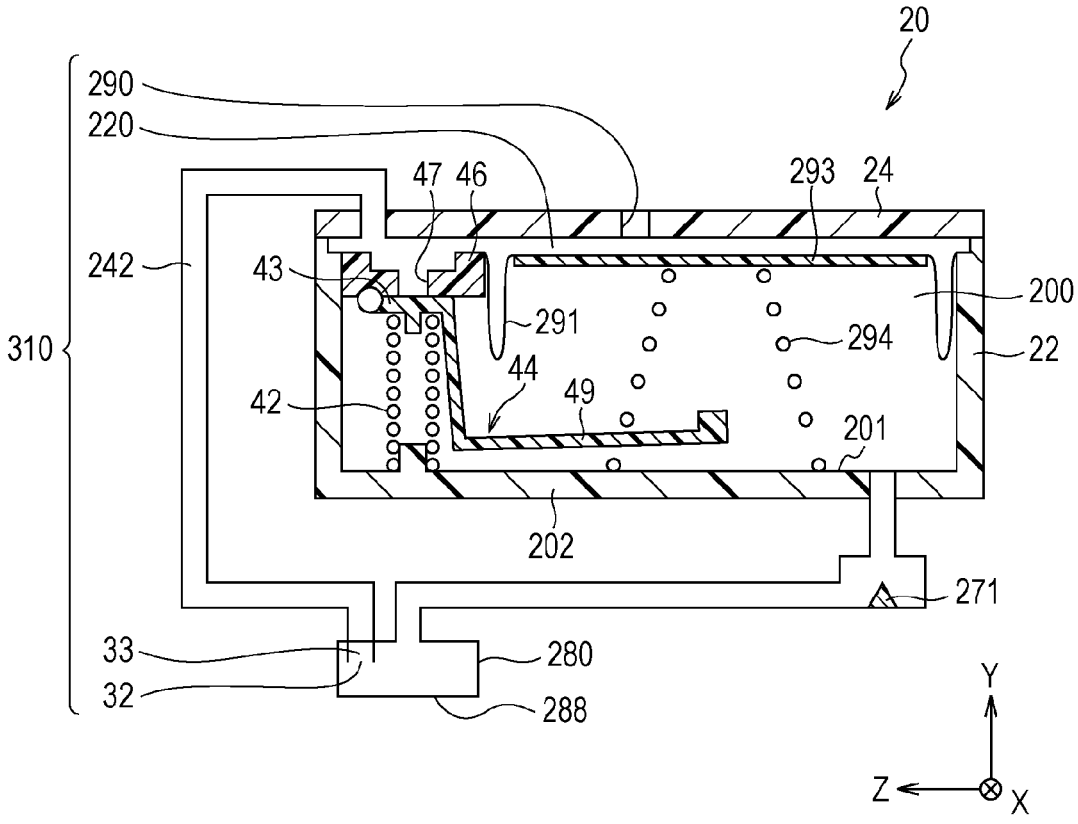
FIG. 14 is a first view for explaining operations of the cartridge.
Figure 15:
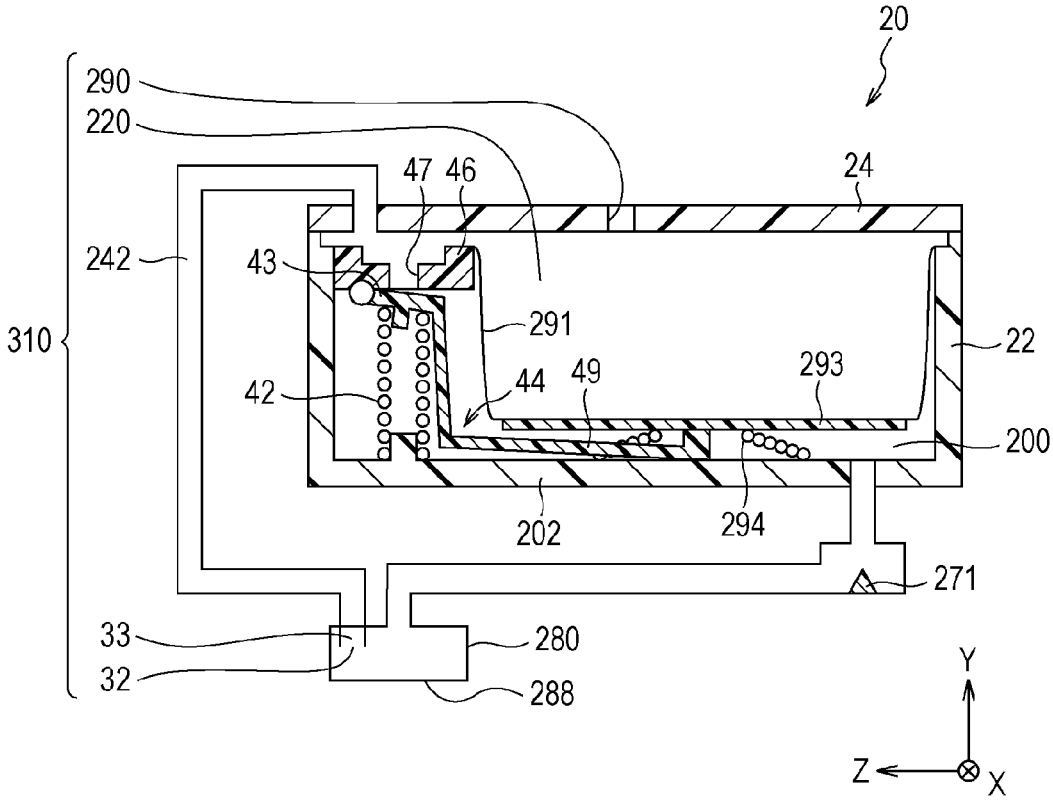
FIG. 15 is a second view for explaining operations of the cartridge.
Figure 16:
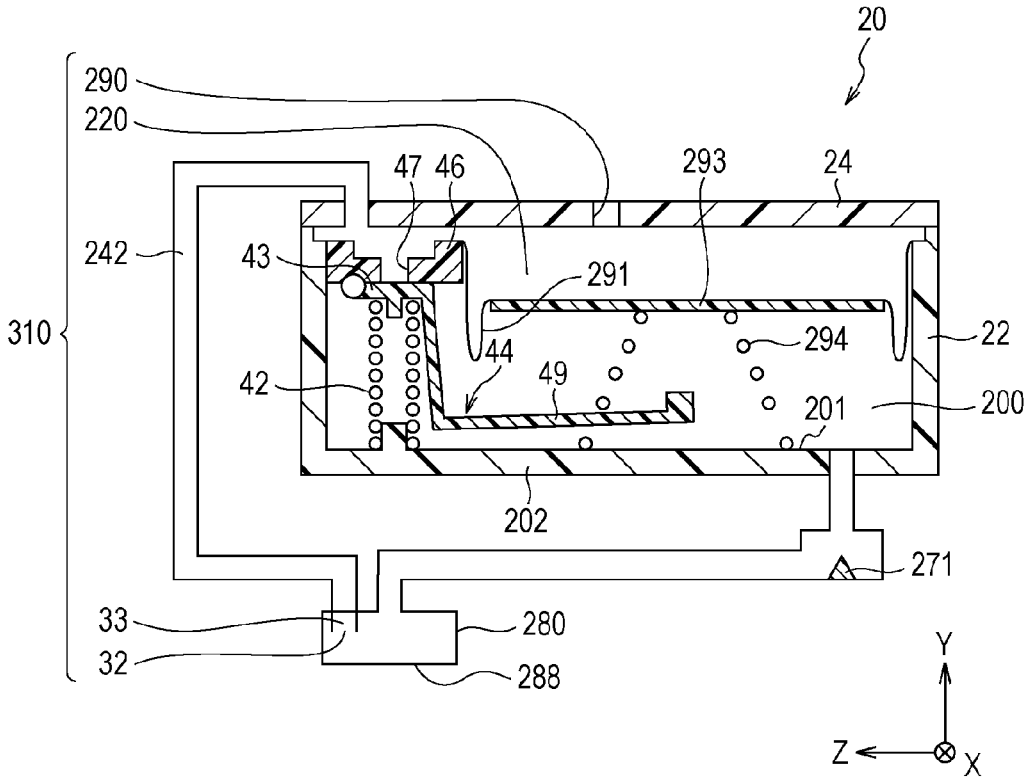
FIG. 16 is a third view for explaining operations of the cartridge.

FIG. 14 is a first view for explaining the operations of the cartridge 20. FIG. 15 is a second view for explaining the operations of the cartridge 20. FIG. 16 is a third view for explaining the operations of the cartridge 20. It is to be noted that FIG. 14 to FIG. 16 are schematic views for explaining the state in the cartridge 20 to be understood easily.

Described is a communication path 310 for communicating the inside and the outside of the liquid supply portion 280 before the operations of the cartridge 20 are described. One edge portion of the communication path 310 corresponds to the communication port 32 and the other edge portion thereof corresponds to the air introduction port 290. The communication path 310 includes a one end-side flow path 33, the first communication chamber 242, and an air chamber 220 in this order halfway in the flow direction of fluid toward the air introduction port 290 from the communication port 32. The one end-side flow path 33 is a flow path formed in the liquid supply portion 280. The air chamber 220 is a space between the lid member 24 and the sheet member 291.

The cartridge 20 includes the communication path 310 as described above to suppress a pressure in the liquid supply portion 280 (to be more specific, a portion including the opening 288 in the liquid supply portion 280 in which the air is present) from being extremely different from the outside pressure.

For example, when the cartridge 20 is attached to the printer 50 (at the time of the attachment operation), the elastic member 648 (FIG. 2) of the holder 60 seals the surrounding of the opening 288 of the liquid supply portion 280. When the elastic member 648 seals the surrounding of the opening 288, a part of the elastic member 648 gets into the liquid supply portion 280 so that the volume in the liquid supply portion 280 is reduced and the pressure in the liquid supply portion 280 is increased. In general, a portion having a high flow path resistance is present on the flow path from the liquid accommodation portion 200 to the liquid flow-out portion 31 such that ink does not leak to the outside from the liquid flow-out portion 31. In the embodiment, for example, the flow path resistance is made higher by the sheet member 36 capable of holding the liquid while forming a meniscus of the liquid and the foam 34. Therefore, in the state immediately after the surrounding of the opening 288 has been sealed and the volume in the liquid supply portion 280 has been reduced, the air by an amount of the reduced volume is not flowed to the liquid accommodation portion 200 sufficiently. However, the air by the amount of the reduced volume can be released to the outside by the communication path 310, thereby keeping the outside pressure and the pressure in the liquid supply portion 280 to be substantially constant.

If the communication path 310 is not provided on the cartridge 20, for example, the compressed air in the liquid supply portion 280 flows into the liquid accommodation portion 200 gradually after the cartridge 20 is attached. This causes a risk that unexpected air enters the liquid accommodation portion 200 and the pressure in the liquid accommodation portion 200 cannot be kept in an appropriate pressure range. Further, for example, if the air in the liquid supply portion 280 flows into the liquid accommodation portion 200 until the increased pressure in the liquid supply portion 280 and the pressure in the liquid accommodation portion 200 become equivalent, the pressure in the liquid accommodation portion 200 is increased in comparison with the state before the air flows into the liquid accommodation portion 200. When a user detaches the cartridge 20 from the holder 60 in this state, the pressure in the liquid supply portion 280 becomes the atmospheric pressure. That is to say, the pressure in the liquid supply portion 280 is lowered and ink leaks to the outside from the liquid accommodation portion 200 in a high pressure through the supply member 30.

Further, for example, a cover (film or cap) for closing the opening 288 is attached to the opening 288 in the unused state of the cartridge 20 in some cases in order to suppress leakage of ink to the outside. Further, the cartridge 20 is accommodated in a packaging of which pressure has been reduced to the pressure lower than the atmospheric pressure in the unused state of the cartridge 20 in some cases. If the cartridge 20 is accommodated in the packaging and the pressure in the packaging is reduced in the state where the cover is attached to the cartridge 20, the pressure in the air chamber 220 is also reduced. With this, an absolute value of the negative pressure in the liquid accommodation portion 200 is increased (that is, the pressure in the liquid accommodation portion 200 becomes more negative). On the other hand, the inner portion of the liquid supply portion 280 is a space in which flowing of the air to/from the outside is suppressed. Therefore, the pressure in the liquid supply portion 280 is kept at the atmospheric pressure immediately after the pressure in the packaging has been reduced. Due to this, the pressure in the liquid supply portion 280 and the pressure in the liquid accommodation portion 200 become non-equivalent and the air flows into the liquid accommodation portion 200 from the liquid supply portion 280 gradually. Further, if the cartridge 20 is taken out from the pressure-reduced package, the pressure in the air chamber 220 returns to the atmospheric pressure and the absolute value of the negative pressure in the liquid accommodation portion 200 also becomes smaller (to be the negative pressure set originally). On the other hand, the pressure in the liquid supply portion 280 is kept to be reduced and there arises a risk that ink leaks to the liquid supply portion 280 from the liquid accommodation portion 200. There arises a risk that the ink leaked to the liquid supply portion 280 side enters the communication port 32 and leaks to the outside from the introduction port 290 through the communication path 310.

Next, the operations of the cartridge 20 are described. As illustrated in FIG. 14, the lever valve 44 includes a valve portion 43 for closing the through-hole 47 and a lever portion 49 for opening and closing the valve portion 43. The liquid accommodation portion 200 is filled with ink in the unused state (before being used) of the cartridge 20. In this state, the valve portion 43 of the lever valve 44 is biased by the spring member 42 so as to close the through-hole 47. Further, the coil spring 294 biases the pressure receiving plate 293 in the direction (+Y-axis direction) of increasing the volume of the liquid accommodation portion 200. With this, the pressure in the liquid accommodation portion 200 is kept at a pressure (negative pressure) lower than the atmospheric pressure.

As illustrated in FIG. 15, if ink in the liquid accommodation portion 200 is consumed and the pressure receiving plate 293 gets closer to the second surface 202 side, the pressure receiving plate 293 presses the lever portion 49 to the second surface 202 side. With this, the valve portion 43 is separated from the through-hole 47 and the outside air and the liquid accommodation portion 200 communicate with each other temporarily. That is to say, the lever valve 44 is made into a valve-open state. Then, the outside air flows into the liquid accommodation portion 200 through the air introduction port 290, the air chamber 220, the ventilation port 292, and the through-hole 47. With this, the volume of the liquid accommodation portion 200 is increased by an amount of the introduced air as illustrated in FIG. 16. At the same time, the negative pressure in the liquid accommodation portion 200 becomes smaller slightly (becomes closer to the atmospheric pressure). Then, as illustrated in FIG. 16, if some amount of the air is introduced to the liquid accommodation portion 200, the pressure receiving plate 293 is separated from the lever portion 49. With this, the valve portion 43 closes the through-hole 47, again. That is to say, the lever valve 44 is made into a valve-close state. In this manner, if the negative pressure in the liquid accommodation portion 200 becomes larger with the consumption of ink in the liquid accommodation portion 200, the lever valve 44 is made into the valve-open state temporarily so as to keep the pressure in the liquid accommodation portion 200 in the appropriate pressure range.

The cap, which will be described later, is attached to the cartridge 20. If the cap is attached, the liquid supply portion 280 is covered by the cap so that leakage of ink from the liquid supply portion 280 is suppressed. Note that as described above, there is a risk that ink leaked from the liquid supply portion 280 when the cartridge 20 is taken out from the packaging and ink leaked from the liquid supply portion 280 due to the impact at the time of conveyance reach the air introduction port 290 through the communication path 310 and leaks to the outside. However, if the cap, which will be described later, is attached to the cartridge 20, even when ink leaks to the outside, adherence of ink to the prism unit 270 (transmitting surface 275) and spreading of ink from the air introduction port 290 in the Z-axis direction are suppressed.

6. Configuration of Cap

Figure 17:
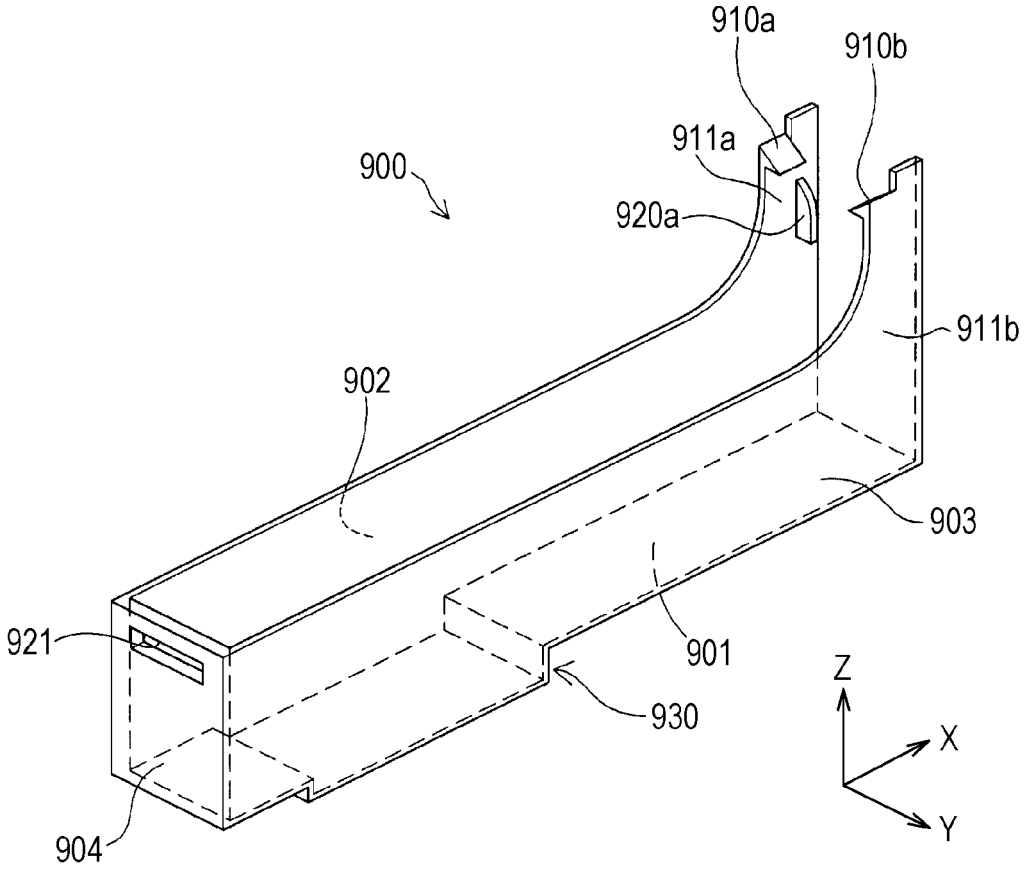
FIG. 17 is a first outer appearance perspective view of a cap according to the first embodiment.
Figure 18:
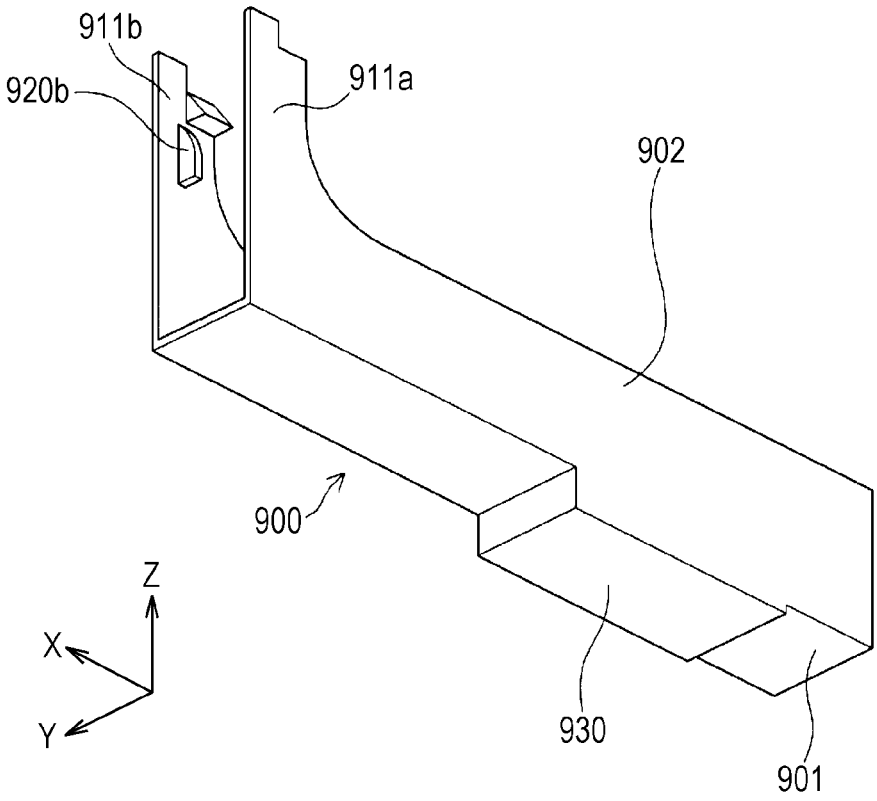
FIG. 18 is a second outer appearance perspective view of the cap according to the first embodiment.
Figure 19:
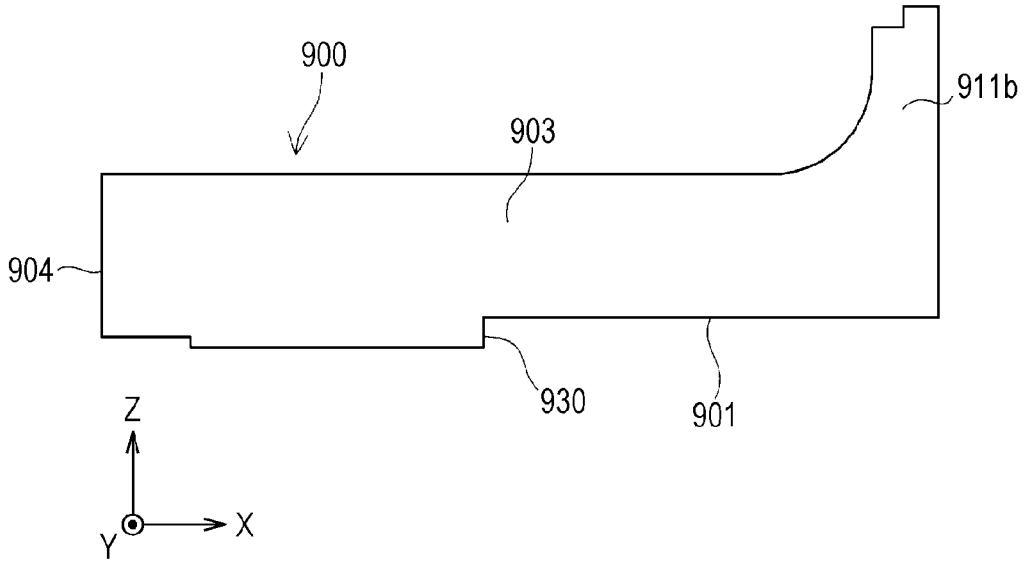
FIG. 19 is a front view of the cap according to the first embodiment.
Figure 20:
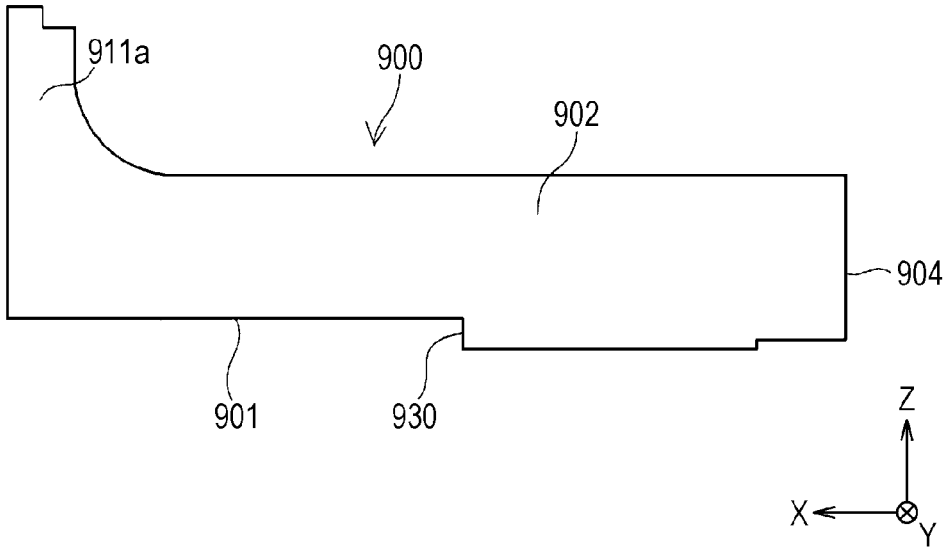
FIG. 20 is a rear view of the cap according to the first embodiment.
Figure 21:
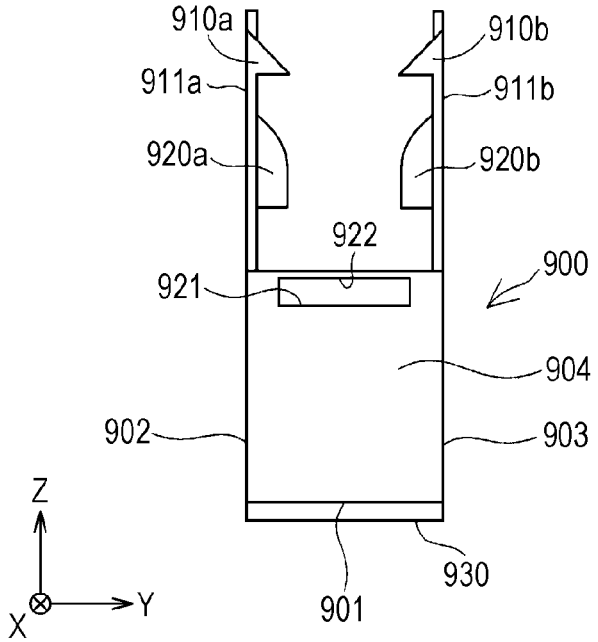
FIG. 21 is a left side view of the cap according to the first embodiment.
Figure 22:
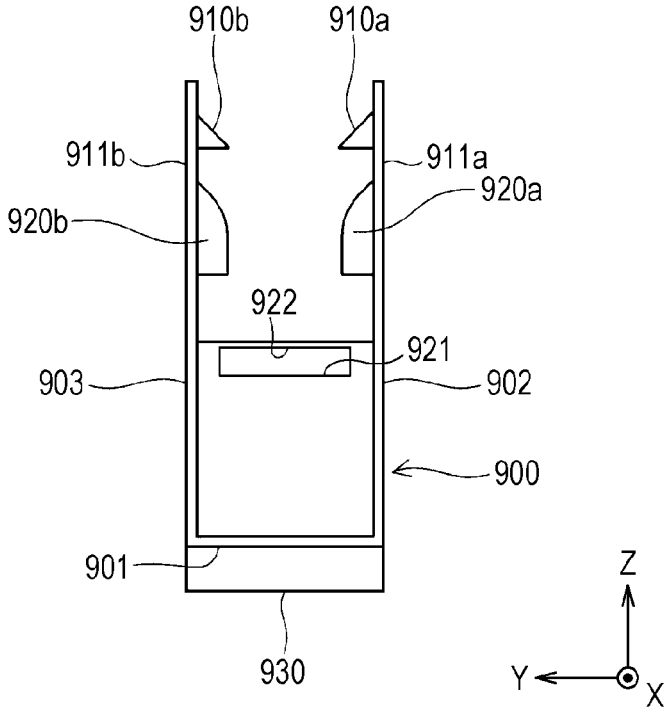
FIG. 22 is a right side view of the cap according to the first embodiment.
Figure 23:
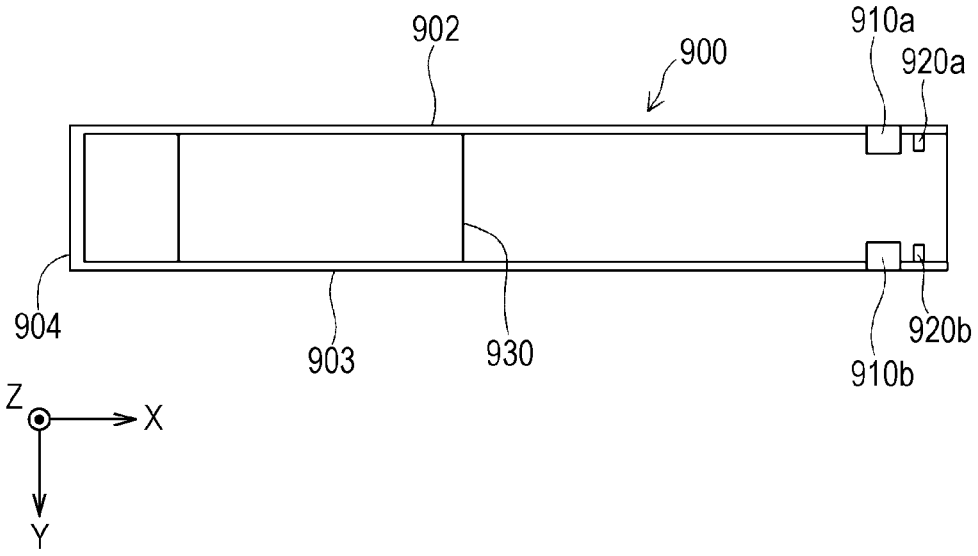
FIG. 23 is a plan view of the cap according to the first embodiment.
Figure 24:
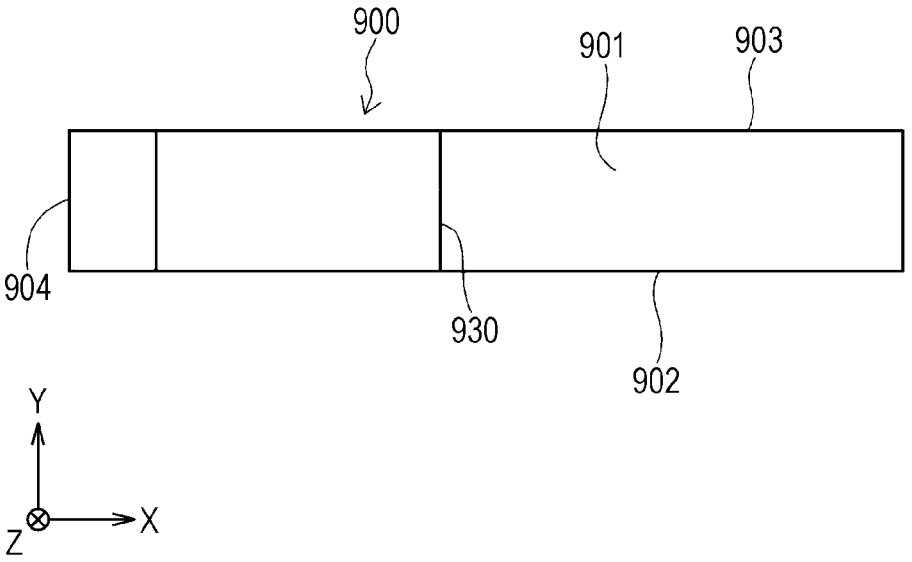
FIG. 24 is a bottom view of the cap according to the first embodiment.

FIG. 17 is a first outer appearance perspective view of the cap according to the first embodiment. FIG. 18 is a second outer appearance perspective view of the cap according to the first embodiment. FIG. 19 is a front view of the cap according to the first embodiment. FIG. 20 is a rear view of the cap according to the first embodiment. FIG. 21 is a left side view of the cap according to the first embodiment. FIG. 22 is a right side view of the cap according to the first embodiment. FIG. 23 is a plan view of the cap according to the first embodiment. FIG. 24 is a bottom view of the cap according to the first embodiment. A cap 900 is attached to the cartridge 20 so as to cover the liquid supply portion 280 (opening 288). The cap 900 is made of a synthetic resin such as polypropylene. In FIG. 17, a configuration of the inner side (side at which the cap 900 makes contact with the cartridge 20 when the cartridge 20 is attached) of the cap 900 is indicated by dashed lines for being understood easily.

As illustrated in FIG. 17 and FIG. 18, the cap 900 includes a bottom portion 901, a first side wall portion 902, a second side wall portion 903, and a third side wall portion 904. The bottom portion 901 is a thin plate-like portion having an outer appearance of rectangular shape when seen from the thickness direction (Z-axis direction). A protrusion 930 projecting to the lower side (−Z-axis direction) is formed on the bottom portion 901.

The first side wall portion 902 is a thin plate-like portion erected in the +Z-axis direction along one long side (edge portion in the +Y-axis direction) of the bottom portion 901. The first side wall portion 902 has an outer appearance of approximate L-shape when seen from the thickness direction (Y-axis direction). A first erecting portion 911*a* is formed on the first side wall portion 902 at the end side in the +X-axis direction. The first erecting portion 911*a* projects in the +Z-axis direction relative to other portions of the first side wall portion 902. A first top pawl portion 910*a* is formed on an upper end (edge portion in the +Z-axis direction) of the first erecting portion 911*a*. As illustrated in FIG. 21 and FIG. 22, the first top pawl portion 910*a* has a claw-like outer appearance shape projecting in the thickness direction (+Y-axis direction) of the first side wall portion 902. The first top pawl portion 910*a* makes contact with the sixth surface 206 of the cartridge 20 in the state where the cap 900 is attached to the cartridge 20.

As illustrated in FIG. 17, FIG. 21 and FIG. 22, a first side pawl portion 920*a* is formed on the surface of the first erecting portion 911*a* that is opposed to the second side wall portion 903. As illustrated in FIG. 21 and FIG. 22, the first side pawl portion 920*a* has a claw-like outer appearance shape projecting in the thickness direction (+Y-axis direction) of the first side wall portion 902. The first side pawl portion 920*a* makes contact with the fifth surface 205 of the cartridge 20 in the state where the cap 900 is attached to the cartridge 20.

The second side wall portion 903 is a thin plate-like portion erected in the +Z-axis direction along the other long side (edge portion in the −Y-axis direction) of the bottom portion 901. In other words, the second side wall portion 903 is opposed to the first side wall portion 902 while sandwiching the bottom portion 901 therebetween. The second side wall portion 903 has an outer appearance of approximate L-shape when seen from the thickness direction (Y-axis direction) like the first side wall portion 902. A second erecting portion 911*b* is formed on the second side wall portion 903 at the end side in the +X-axis direction. The second erecting portion 911*b* projects in the +Z-axis direction relative to other portions of the second side wall portion 903. A second top pawl portion 910*b* is formed on an upper end (edge portion in the +Z-axis direction) of the second erecting portion 911*b*. The second top pawl portion 910*b* is arranged at a position opposed to the first top pawl portion 910*a* in the Y-axis direction. The second top pawl portion 910*b* has a claw-like outer appearance shape projecting in the thickness direction (−Y-axis direction) of the second side wall portion 903. The second top pawl portion 910*b* makes contact with the sixth surface 206 of the cartridge 20 in the state where the cap 900 is attached to the cartridge 20 like the first top pawl portion 910*a*.

As illustrated in FIG. 18, FIG. 21 and FIG. 22, a second side pawl portion 920*b* is formed on the surface of the second erecting portion 911*b* that is opposed to the first side wall portion 902. The second side pawl portion 920*b* is arranged at a position opposed to the first side pawl portion 920*a* in the Y-axis direction. The second side pawl portion 920*b* has a claw-like outer appearance shape projecting in the thickness direction (−Y-axis direction) of the second side wall portion 903. The second side pawl portion 920*b* makes contact with the fifth surface 205 of the cartridge 20 in the state where the cap 900 is attached to the cartridge 20 like the first side pawl portion 920*a*.

As illustrated in FIG. 17, FIG. 23 and FIG. 24, the third side wall portion 904 is a thin plate-like portion erected in the +Z-axis direction along one short side (edge portion in the −X-axis direction) of the bottom portion 901. The third side wall portion 904 has a rectangular outer appearance shape when seen from the thickness direction (X-axis direction). Two edge portions of the third side wall portion 904, which intersect with the edge portion that makes contact with the bottom portion 901 perpendicularly, make contact with the first side wall portion 902 and the second side wall portion 903, respectively. In other words, the third side wall portion 904 makes contact with the bottom portion 901, the first side wall portion 902, and the second side wall portion 903 perpendicularly. The third side wall portion 904 includes an engagement hole 921 at a position closer to the edge portion opposite to the edge portion that makes contact with the bottom portion 901. The engagement hole 921 is formed as a through-hole that penetrates through the third side wall portion 904 in the thickness direction. The second locking portion 221 of the cartridge 20 can be inserted into the engagement hole 921.

Both the side of the cap 900 that is opposed to the bottom portion 901 and the side of the cap 900 that is opposed to the third side wall portion 904 are opened. The cartridge 20 is attached to the cap 900 and the cartridge 20 is detached from the cap 900 by using these opened portions. It is to be noted that the first side wall portion 902 makes contact with the bottom portion 901 and the third side wall portion 904 but the edge portion of the first side wall portion 902 in the +Z-axis direction and the edge portion of the first side wall portion 902 in the +X-axis direction do not make contact with any part. With this, at least the first erecting portion 911*a* of the first side wall portion 902 can be deflected in the −Y-axis direction. In the same manner, at least the second erecting portion 911*b* of the second side wall portion 903 can be deflected in the +Y-axis direction.

7. Cartridge 20 to which Cap 900 is Attached

Figure 25:
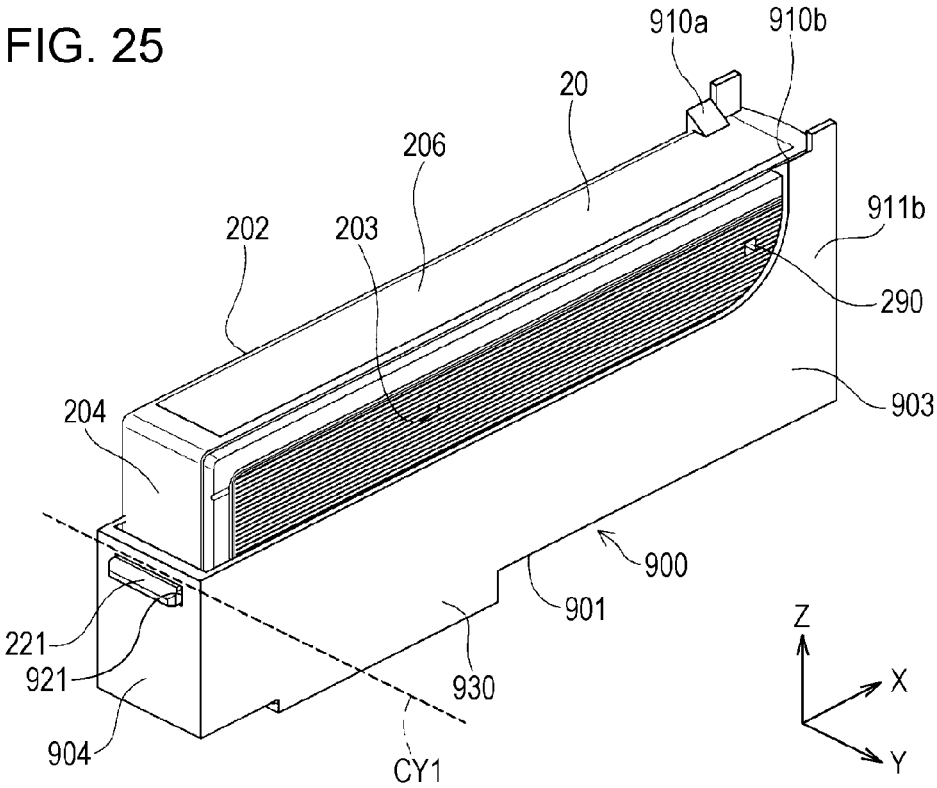
FIG. 25 is a first outer appearance perspective view of the cartridge to which the cap is attached.
Figure 26:
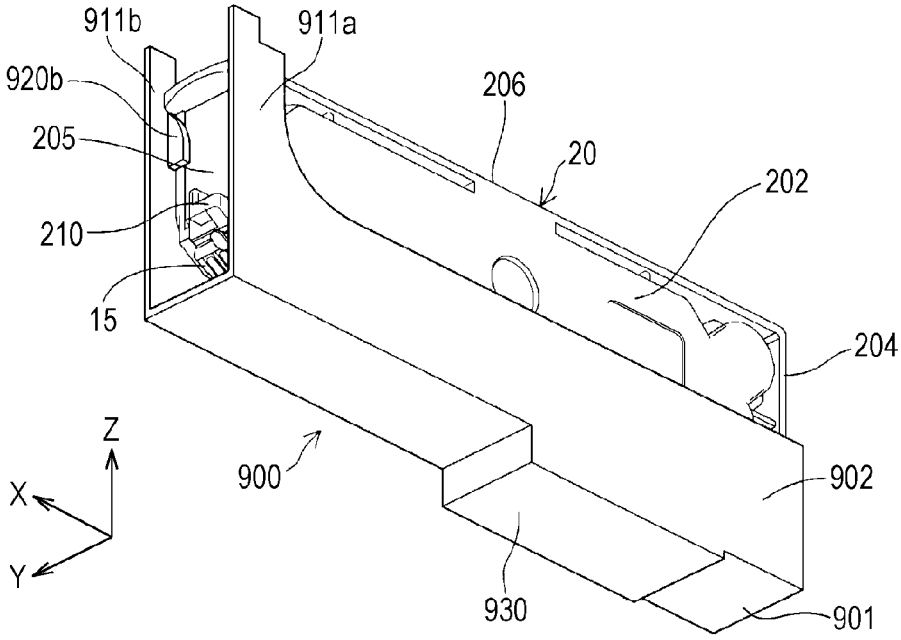
FIG. 26 is a second outer appearance perspective view of the cartridge to which the cap is attached.
Figure 27:
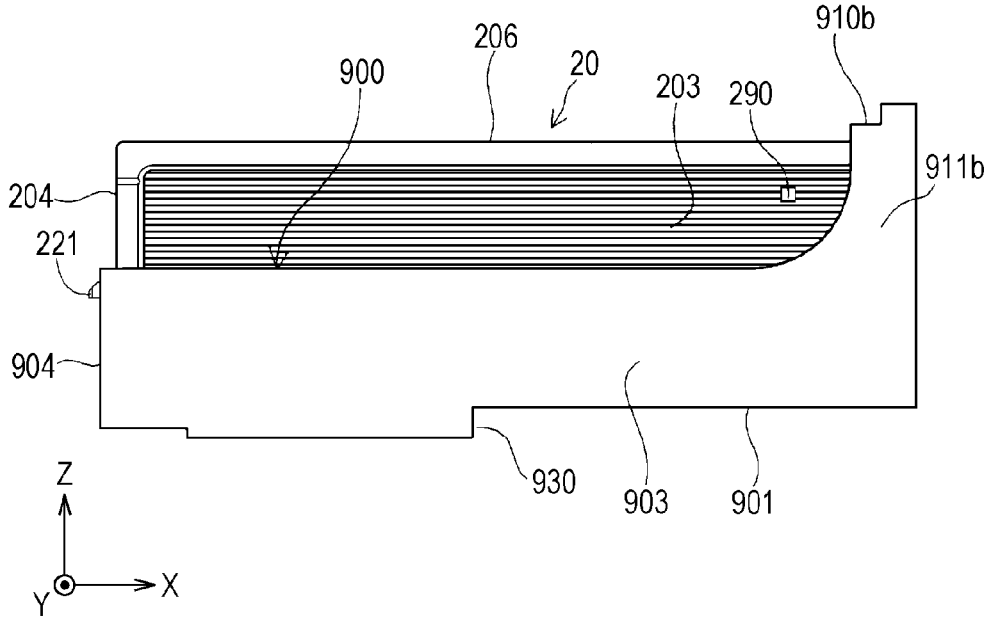
FIG. 27 is a front view of the cartridge to which the cap is attached.
Figure 28:
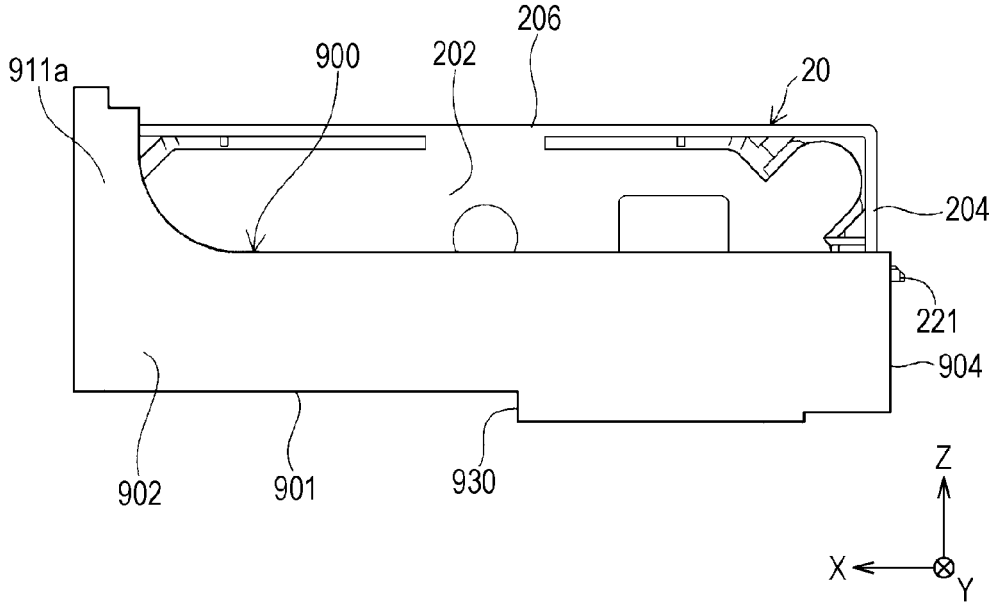
FIG. 28 is a rear view of the cartridge to which the cap is attached.
Figure 29:
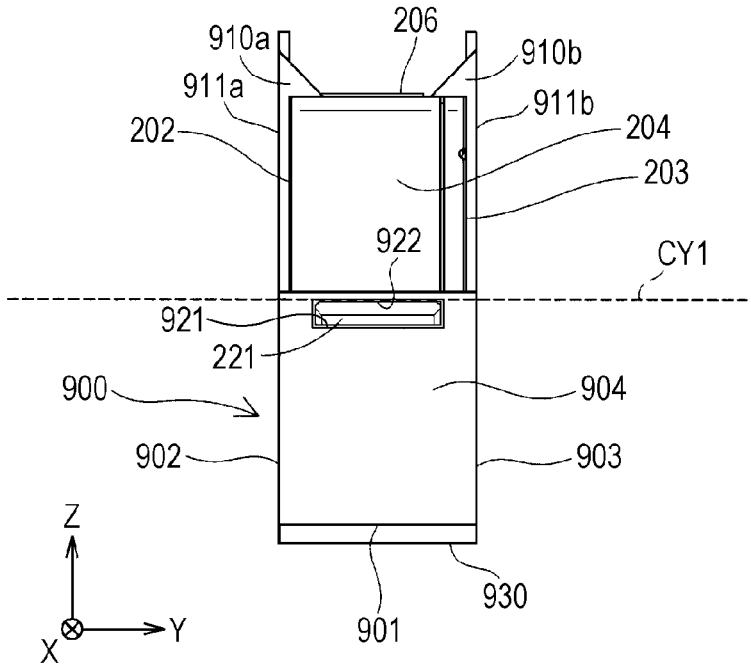
FIG. 29 is a left side view of the cartridge to which the cap is attached.
Figure 30:
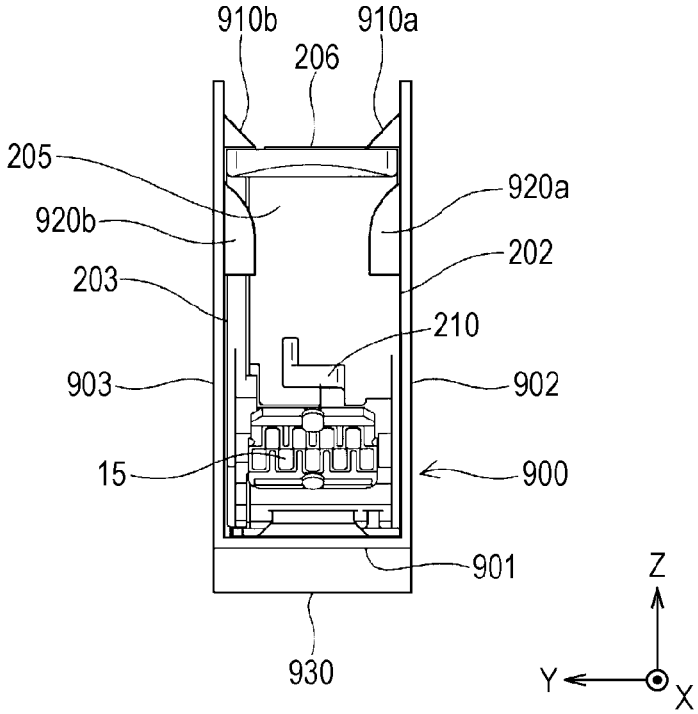
FIG. 30 is a right side view of the cartridge to which the cap is attached.
Figure 31:
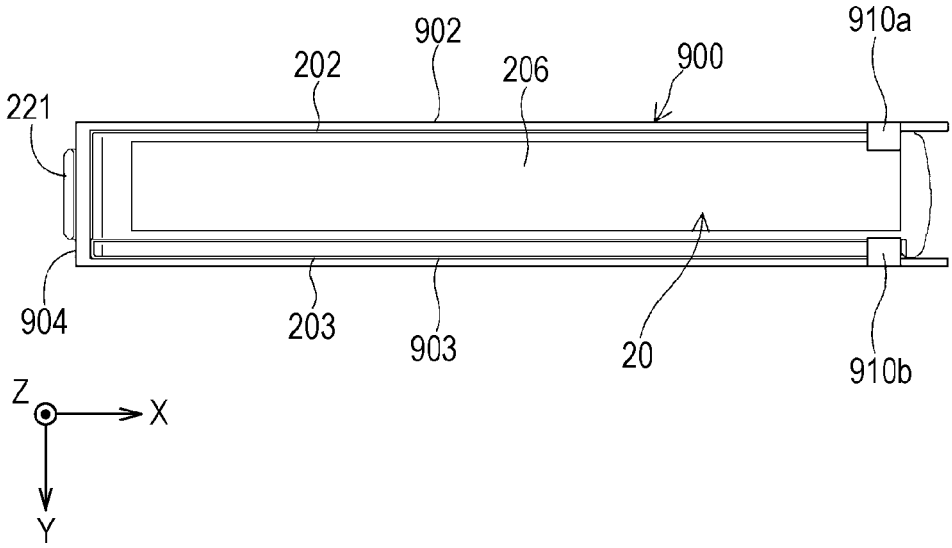
FIG. 31 is a plan view of the cartridge to which the cap is attached.
Figure 32:
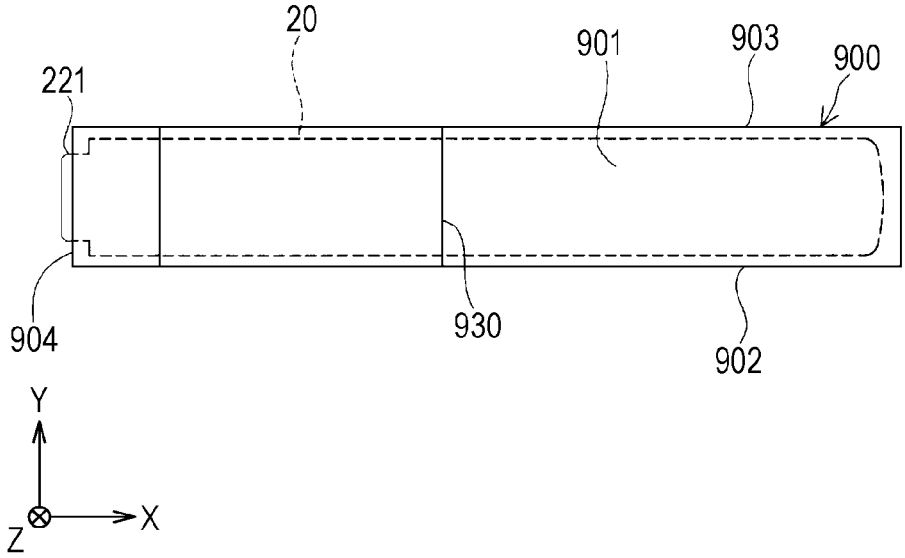
FIG. 32 is a bottom view of the cartridge to which the cap is attached.
Figure 33:
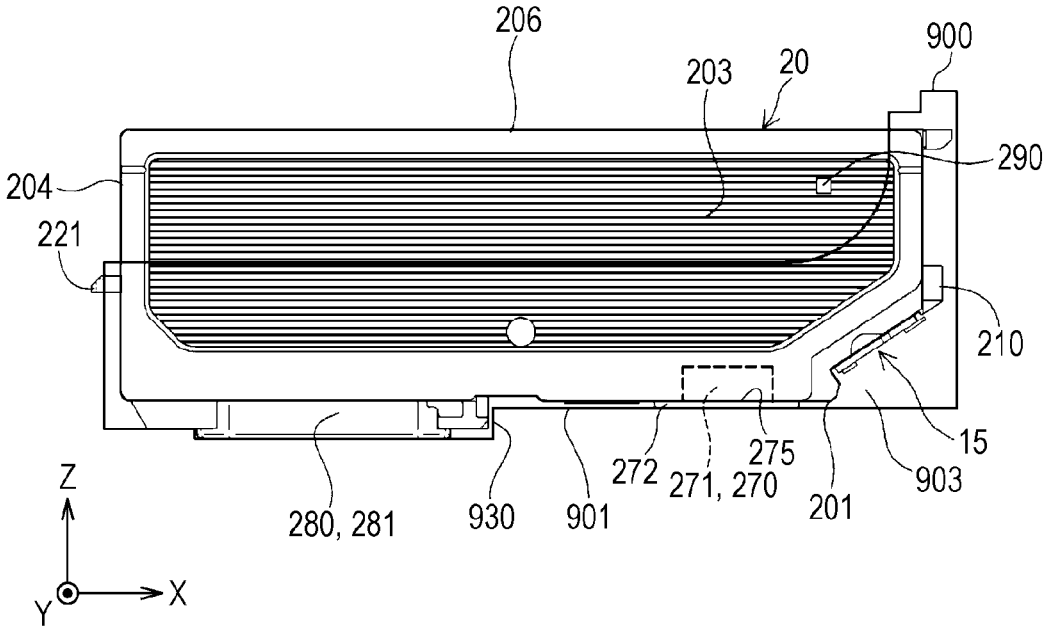
FIG. 33 is a front transparent view of the cartridge to which the cap is attached.

FIG. 25 is a first outer appearance perspective view of the cartridge 20 to which the cap 900 is attached. FIG. 26 is a second outer appearance perspective view of the cartridge 20 to which the cap 900 is attached. FIG. 27 is a front view of the cartridge 20 to which the cap 900 is attached. FIG. 28 is a rear view of the cartridge 20 to which the cap 900 is attached. FIG. 29 is a left side view of the cartridge 20 to which the cap 900 is attached. FIG. 30 is a right side view of the cartridge 20 to which the cap 900 is attached. FIG. 31 is a plan view of the cartridge 20 to which the cap 900 is attached. FIG. 32 is a bottom view of the cartridge 20 to which the cap 900 is attached. FIG. 33 is a front transparent view of the cartridge 20 to which the cap 900 is attached. In FIG. 32, the cartridge 20 is indicated by a dashed line for being understood easily. In FIG. 33, a portion of the cartridge 20 that is hidden by the second side wall portion 903 of the cap 900 is illustrated transparently.

As illustrated in FIG. 25, FIG. 29, FIG. 31 and FIG. 32, in the state where the cap 900 is attached to the cartridge 20, the second locking portion 221 of the cartridge 20 is inserted into the engagement hole 921 of the cap 900 (third side wall portion 904) and the front end thereof is exposed from the cap 900 (third side wall portion 904) in the −X-axis direction. In this case, as illustrated in FIG. 25 and FIG. 29, the upper end surface of the second locking portion 221 in the vertical direction abuts against the upper end of the engagement hole 921 in the vertical direction (wall surface that is formed in the third side wall portion 904, forms the engagement hole 921, and is parallel with the X-axis and the Y-axis) 922.

As illustrated in FIG. 25, FIG. 29, FIG. 30 and FIG. 31, in the state where the cap 900 is attached to the cartridge 20, two first top pawl portions 910*a* and 910*b* make contact with the sixth surface 206 of the cartridge 20. Further, as illustrated in FIG. 33, in the state where the cap 900 is attached to the cartridge 20, the first surface 201 of the cartridge 20 makes contact with the bottom portion 901 of the cap 900. Accordingly, in the state where the cap 900 is attached to the cartridge 20, the cartridge 20 is held between the two top pawl portions 910*a* and 910*b* and the bottom portion 901. This makes it possible to position the cap 900 and the cartridge 20 in the Z-axis direction reliably.

As illustrated in FIG. 26 and FIG. 30, in the state where the cap 900 is attached to the cartridge 20, two first side pawl portions 920*a* and 920*b* make contact with the fifth surface 205 of the cartridge 20. Further, as illustrated in FIG. 25, FIG. 31 and FIG. 33, in the state where the cap 900 is attached to the cartridge 20, the fourth surface 204 of the cartridge 20 makes contact with the third side wall portion 904. Accordingly, in the state where the cap 900 is attached to the cartridge 20, the cartridge 20 is held between the two side pawl portions 920*a* and 920*b* and the third side wall portion 904. This makes it possible to position the cap 900 and the cartridge 20 in the X-axis direction reliably.

As illustrated in FIG. 33, in the state where the cap 900 is attached to the cartridge 20, the transmitting surface 275 of the cartridge 20 is located at the lower side in the vertical direction (−Z-axis direction) relative to the air introduction port 290. As illustrated in FIG. 33, in the state where the cap 900 is attached to the cartridge 20, the liquid supply portion 280 of the cartridge 20 is accommodated in a space surrounded by the protrusion 930, the first side wall portion 902 and the second side wall portion 903 of the cap 900. Further, the liquid supply portion 280 (surrounding wall portion 281) makes contact with the protrusion 930. In this manner, the surrounding wall portion 281 is covered by the cap 900 (protrusion 930).

Figure 34:
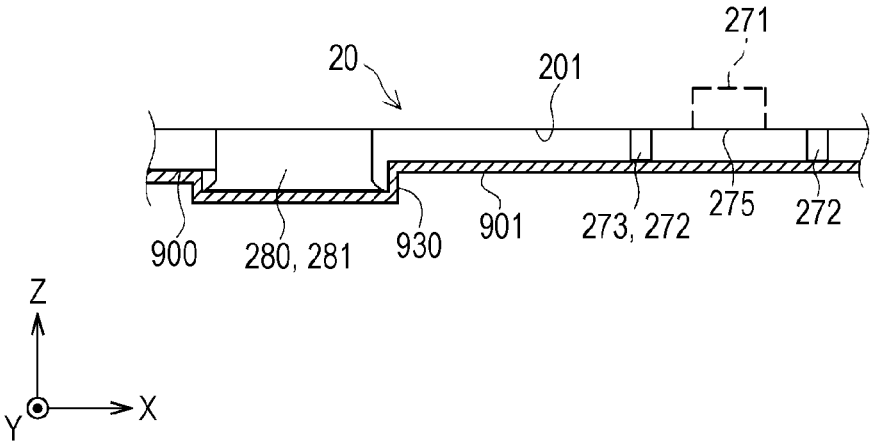
FIG. 34 is a descriptive view illustrating a part of a boundary portion between a first surface and a wall portion and a bottom portion in the state where the cap is attached to the cartridge in an enlarged manner.

FIG. 34 is a descriptive view illustrating a part of the boundary portion between the first surface 201 and the wall portion 272 and the bottom portion 901 in the state where the cap 900 is attached to the cartridge 20 in an enlarged manner. It is to be noted that in FIG. 34, a part of the boundary portion between the first surface 201 and the bottom portion 901 is illustrated schematically. As illustrated in FIG. 34, in the state where the cap 900 is attached to the cartridge 20, the wall portion 272 of the cartridge 20 makes contact with the bottom portion 901 of the cap 900. The separation wall portion 273 is arranged between the liquid supply portion 280 and the transmitting surface 275 in the X-axis direction. Further, the separation wall portion 273 makes contact with the bottom portion 901. Accordingly, even if ink leaks to the outside of the liquid supply portion 280 (space between the bottom portion 901 and the first surface 201) from the liquid supply portion 280, ink is held back by the separation wall portion 273, thereby suppressing the ink from reaching the transmitting surface 275.

Figure 35:
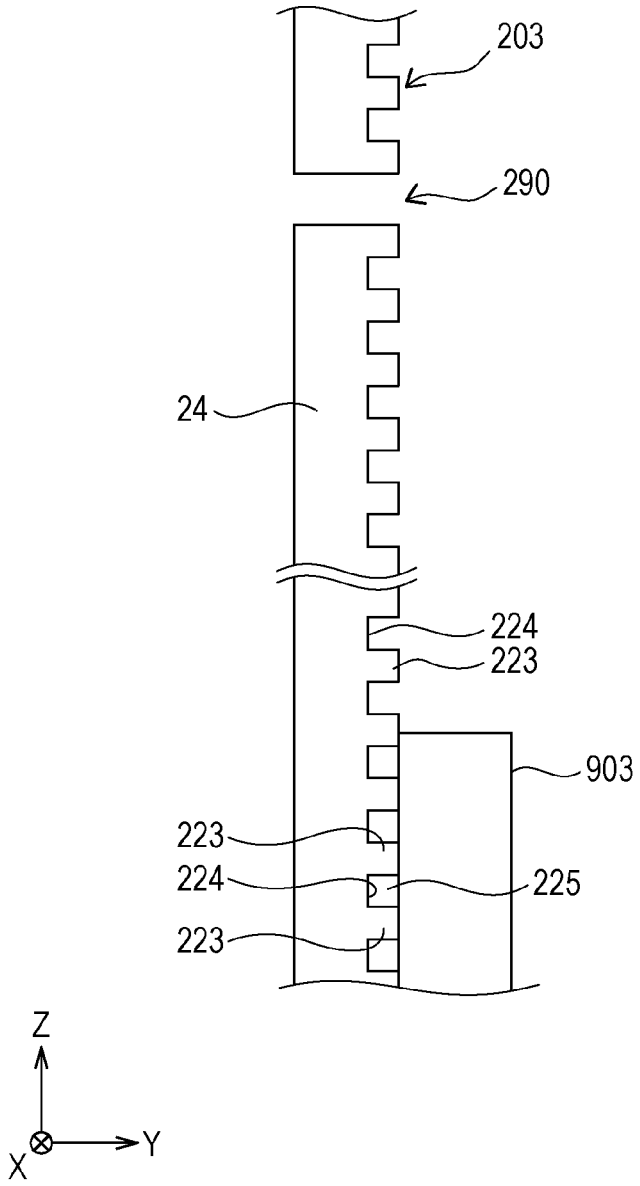
FIG. 35 is a plan view schematically illustrating a part of a contact portion between a lid member and the cap in the state where the cap is attached to the cartridge in an enlarged manner.

FIG. 35 is a plan view schematically illustrating a part of a contact portion between the lid member 24 and the cap 900 in the state where the cap 900 is attached to the cartridge 20 in an enlarged manner. As illustrated in FIG. 35, protrusions 223 and recesses 224 forming grooves are formed on the surface of the lid member 24 that forms the third surface 203. The protrusions 223 and the recesses 224 are formed so as to be aligned alternately along the Z-axis. The protrusions 223 project to the +Y-axis direction (direction toward the third surface 203 from the second surface 202) and are provided so as to extend in the X-axis direction. The recesses 224 are concaved in the −Y-axis direction relative to the protrusions 223 and are provided so as to extend in the X-axis direction. These shapes can be also said as bar shapes, groove shapes, a comb-tooth pattern, a saw-tooth pattern, a wave-line shape, a jagged shape, or the like. In the state where the cap 900 is attached to the cartridge 20, the second side wall portion 903 makes contact with the protrusions 223. With this, a number of spaces 225 surrounded by the second side wall portion 903, the protrusions 223, and the recesses 224 are formed. The spaces 225 are provided so as to extend in the X-axis direction and are arranged in parallel with one another. Further, the respective spaces 225 are partitioned from one another by the protrusions 223 in the Z-axis direction.

If ink leaks to the outside from the air introduction port 290 in the state where the cap 900 is attached to the cartridge 20, there arises a risk that the ink flows to the lower side in the vertical direction (−Z-axis direction) along the third surface 203 and flows into between the second side wall portion 903 and the lid member 24. The ink flowed into between the second side wall portion 903 and the lid member 24 is accumulated in the spaces 225, thereby suppressing the ink from flowing to the lower side in the vertical direction. Further, the adjacent spaces 225 are partitioned from one another by the protrusions 223, thereby suppressing the ink from flowing to the lower side in the vertical direction. With this, the ink leaked from the air introduction port 290 is suppressed from reaching the transmitting surface 275 of the first surface 201. In addition, the ink can be suppressed from flowing vertically. This makes it possible to suppress spreading and scattering of the ink leaked from the air introduction port 290.

Figure 36:
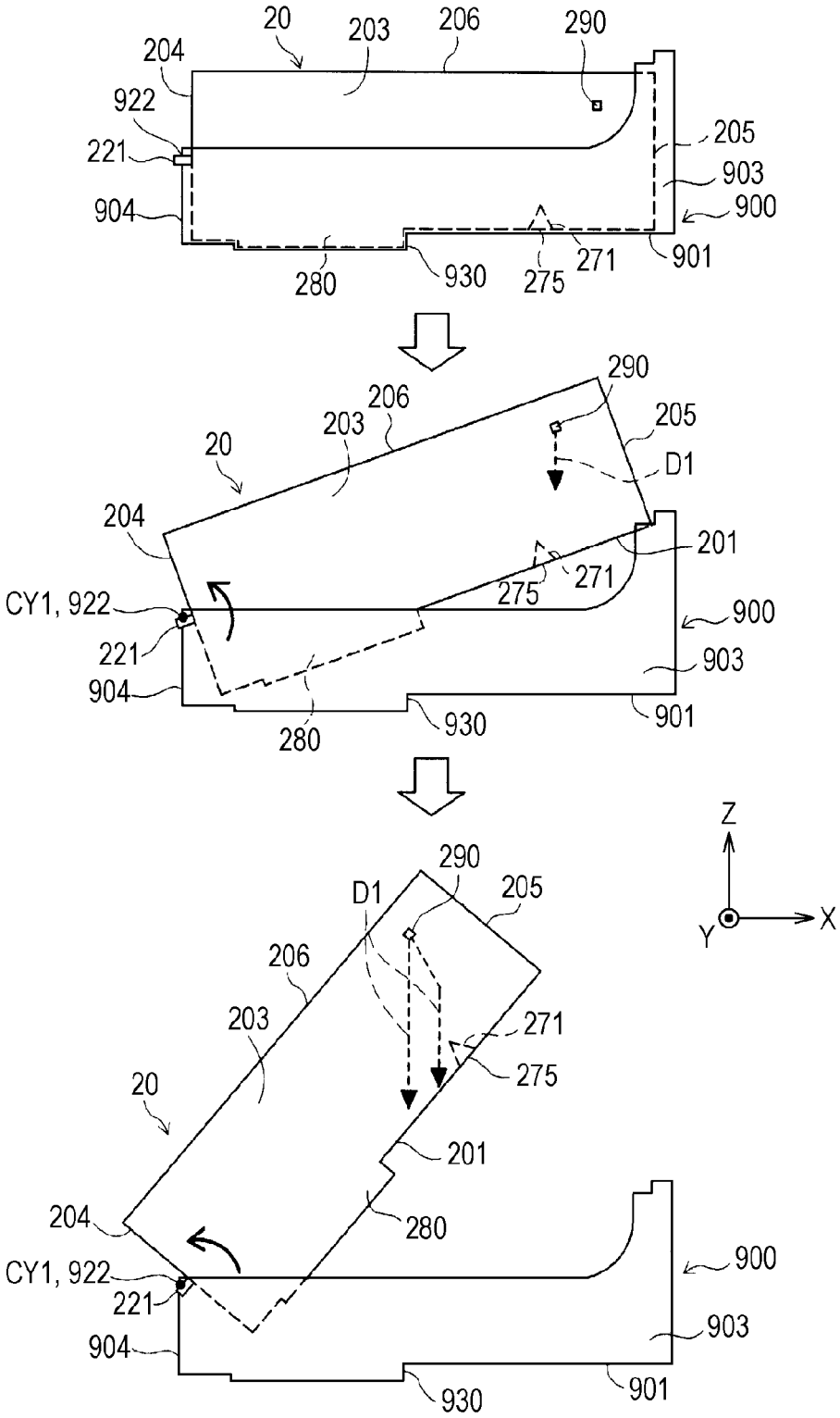
FIG. 36 is a descriptive view schematically illustrating a state when the cap is detached from the cartridge in the first embodiment.

FIG. 36 is a descriptive view schematically illustrating a state when the cap 900 is detached from the cartridge 20 in the first embodiment. In FIG. 36, the cartridge 20 and the cap 900 are illustrated when seen from the −Y-axis direction. It is to be noted that in FIG. 36, the outer appearance (contour) of the cartridge 20 is illustrated schematically.

In the state where the cap 900 is attached to the cartridge 20 as illustrated in the upper portion in FIG. 36, if a user deflects the first erecting portion 911*a* of the cap 900 in the −Y-axis direction and deflects the second erecting portion 911*b* of the cap 900 in the +Y-axis direction, the two top pawl portions 910*a* and 910*b* are separated from the sixth surface 206 of the cartridge 20 and the two side pawl portions 920*a* and 920*b* are separated from the fifth surface 205 of the cartridge 20. If the user tries to lift the cartridge 20 (tries to move the cartridge 20 so as to be separated from the cap 900) in this state while fixing the cap 900, the cartridge 20 is moved rotationally about a portion as a rotational center on which the second locking portion 221 and the engagement hole 921 make contact with each other as illustrated in the middle portion in FIG. 36. To be more specific, the cartridge 20 is moved rotationally in the direction of being separated from the cap 900 about a virtual line CY1 as the rotational center as illustrated in FIG. 25 and FIG. 29. In this case, the cartridge 20 is moved rotationally so as to be parallel with the plane that is parallel with the X-axis and the Z-axis.

As illustrated in the middle portion in FIG. 36, if ink leaks from the air introduction port 290 during the rotational movement of the cartridge 20, the leaked ink D1 moves to the lower side (−Z-axis direction) in the vertical direction and flows toward the transmitting surface 275. However, as illustrated in the lower position in FIG. 36, if the cartridge 20 is further moved rotationally in the direction of being separated from the cap 900, the ink D1 leaked from the air introduction port 290 flows in the direction of being distanced from the transmitting surface 275.

Figure 37:
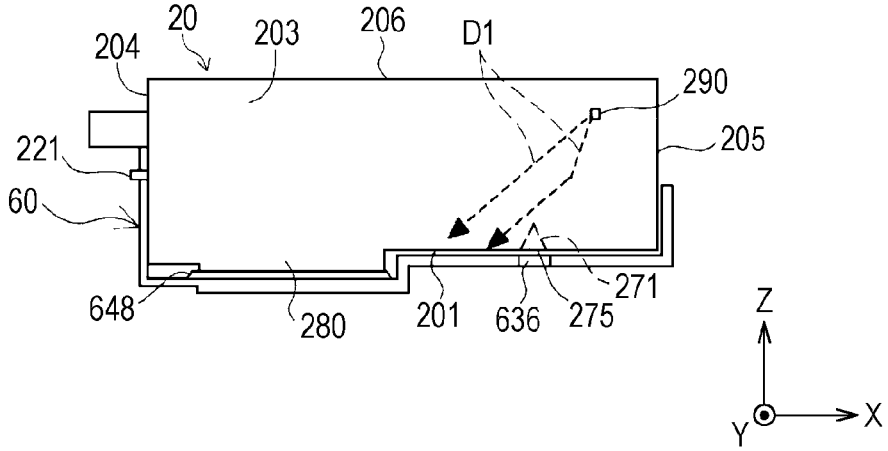
FIG. 37 is a descriptive view schematically illustrating a state where the cartridge is attached to the holder.

FIG. 37 is a descriptive view schematically illustrating the state where the cartridge 20 is attached to the holder 60. In FIG. 37, the cartridge 20 and the holder 60 when seen from the −Y-axis direction are illustrated. In FIG. 37, the outer appearances (contours) of the cartridge 20 and the holder 60 are illustrated schematically.

If the cap 900 is detached completely from the cartridge 20 from the above-mentioned state as illustrated in the lower position in FIG. 36 and the cartridge 20 is attached to the holder 60, a state as illustrated in FIG. 37 is made. As illustrated in FIG. 37, the ink D1 leaked from the air introduction port 290 is present at a position closer to the fourth surface 204 relative to the transmitting surface 275 and flows down to the lower side in the vertical direction (−Z-axis direction) at the corresponding position. Accordingly, the ink D1 does not adhere to the transmitting surface 275 so that false detection of presence/absence of ink is suppressed when the transmitting surface 275 is irradiated with light through the through-hole 636.

It is to be noted that the above-mentioned liquid flow-out portion 31 corresponds to a liquid supply portion in an aspect of the invention. The surrounding wall portion corresponds to a surrounding wall portion in the aspect of the invention. The communication port 32 corresponds to a communication port in the aspect of the invention. The protrusions 223 on the lid member 24 correspond to a protrusion in the aspect of the invention. The protrusion 930 of the cap 900 corresponds to a covering portion in the aspect of the invention. The portion of the second side wall portion 903 that makes contact with the protrusions 223 on the lid member 24 corresponds to a first cover portion in the aspect of the invention. The prism unit 270 corresponds to a detection member in the aspect of the invention. The transmitting surface 275 corresponds to an exposed portion in the aspect of the invention. The separation wall portion 273 corresponds to a projecting portion in the aspect of the invention. The portion of the bottom portion 901 that makes contact with the separation wall portion 273 corresponds to a second cover portion in the aspect of the invention. The second locking portion 221 corresponds to a container-side engagement portion in the aspect of the invention. The engagement hole 921 corresponds to a cover-side engagement portion in the aspect of the invention. The virtual line CY1 corresponds to a virtual line in the aspect of the invention.

8. Effects

In the above-mentioned first embodiment, in the state where the cap 900 (protrusion 930) is attached to the cartridge 20, the cap 900 (protrusion 930) closes the opening 288 of the cartridge 20. This makes it possible to reduce the possibility that ink leaks from the opening 288 at the time of conveyance of the cartridge 20 or the like. In addition, in the state where the cap 900 is attached to the cartridge 20, the second side wall portion 903 of the cap 900 makes contact with the protrusions 223 of grooves formed on the third surface 203 (lid member 24), thereby forming the spaces 225 surrounded by the second side wall portion 903, the protrusions 223 and the recesses 224. Accordingly, when the ink leaks from the air introduction port 290 and enters between the second side wall portion 903 and the lid member 24, the ink can be accumulated in the spaces 225. In addition, the adjacent spaces 225 in the Z-axis direction are partitioned by the protrusions 223, thereby suppressing movement of the ink to the adjacent spaces 255. Therefore, the ink can be suppressed from flowing down to the lower side in the vertical direction (−Z-axis direction) from the air introduction port 290 and the ink leaked from the air introduction port 290 can be suppressed from reaching the transmitting surface 275. Therefore, false detection of presence/absence of ink due to the adherence of ink to the transmitting surface 275 can be suppressed.

Further, the wall portion 272 projecting in the −Z-axis direction is formed on the first surface 201 of the cartridge 20 so as to surround the transmitting surface 275. The wall portion 272 has the separation wall portion 273 located between the liquid supply portion 280 and the transmitting surface 275. Accordingly, even when the ink leaked from the liquid supply portion 280 moves toward the transmitting surface 275, the separation wall portion 273 can hold back the ink, thereby suppressing the ink from reaching the transmitting surface 275.

Further, both the air introduction port 290 and the transmitting surface 275 are arranged at positions closer to the intersecting edge portion between the third surface 203 and the fifth surface 205 rather than to the intersecting edge portion between the third surface 203 and the fourth surface 204 on the cartridge 20. In addition, the cap 900 and the cartridge 20 rotate relatively so as to be separated from each other when the cap 900 is detached from the cartridge 20. In this case, the cap 900 and the cartridge 20 rotate about the virtual line CY1, as the rotational center, passing through the upper end of the engagement hole 921 of the cap 900 and extending in the Y-axis direction. Accordingly, even if ink leaks from the air introduction port 290 when the cartridge 20 is rotated while fixing the cap 900 such that the first side wall portion 902 is on a horizontal plane, the leaked ink (ink D1 in FIG. 36) is made to flow toward the fourth surface 204 so as to be distanced from the transmitting surface 275. Therefore, the ink leaked from the air introduction port 290 can be suppressed from reaching the transmitting surface 275.

Second Embodiment

Figure 38:
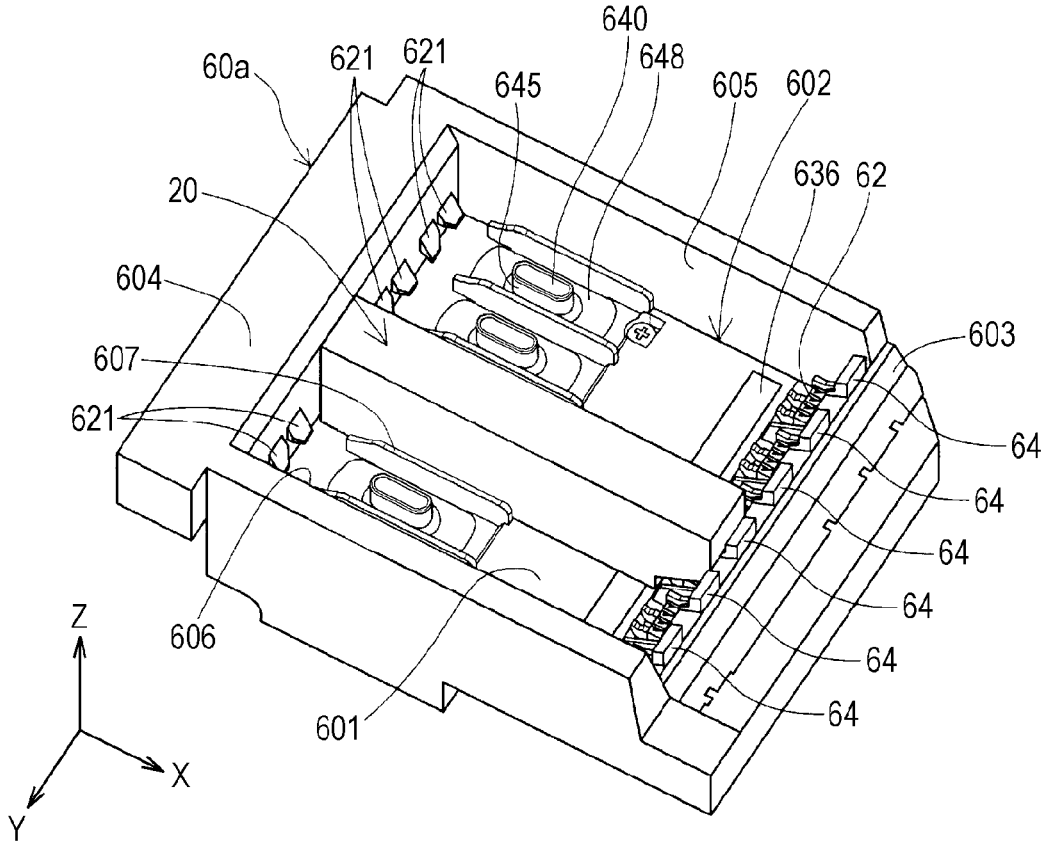
FIG. 38 is a perspective view illustrating a holder according to a second embodiment to which the cartridge is attached.

FIG. 38 is a perspective view illustrating a holder 60*a* according to a second embodiment to which the cartridge 20 is attached. The holder 60*a* in the second embodiment is different from the holder 60 in the first embodiment as illustrated in FIG. 2 and FIG. 3 in a respect that the holder 60*a* includes a pair of holder engagement portions 621 on each slot. Other configurations of the holder 60*a* in the second embodiment are the same as those of the holder 60 in the first embodiment. The holder engagement portions 621 have claw-like outer appearance shapes and project in the direction toward the wall portion 603 from the wall portion 604 at the inner side (side opposed to the recess) of the wall portion 604. The pair of holder engagement portions 621 are inserted into the recesses 207 of the cartridge 20 in the state where the cartridge 20 is attached. In other words, the recesses 207 of the cartridge 20 are engaged with the holder engagement portions 621 of the holder 60*a*. With this, the holder 60*a* and the cartridge 20 are locked reliably.

Figure 39:
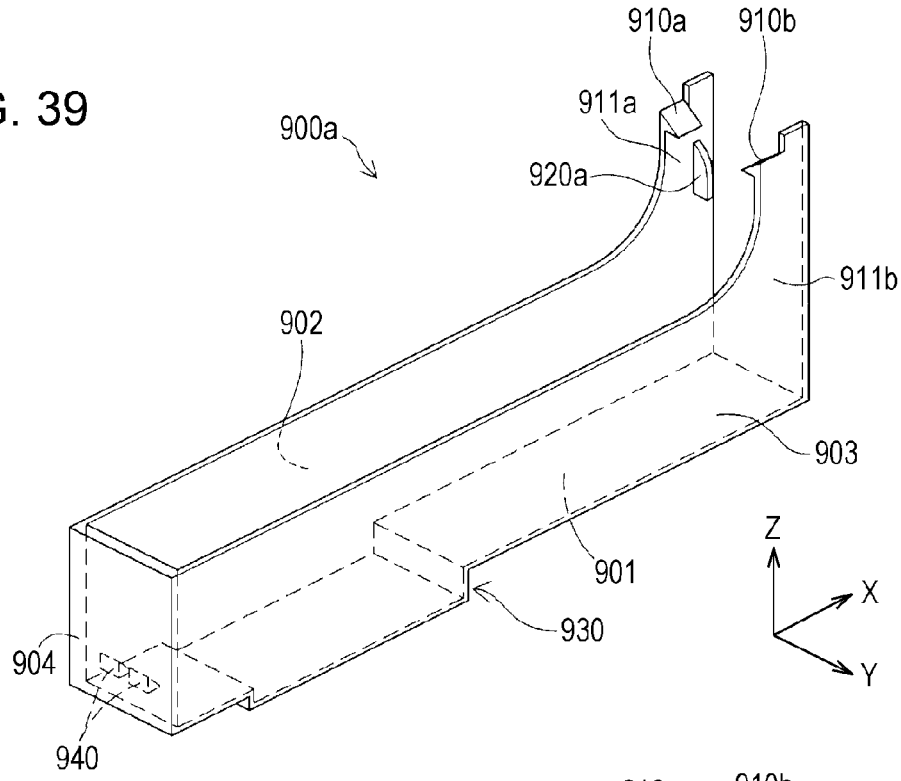
FIG. 39 is an outer appearance perspective view illustrating a cap according to the second embodiment.

FIG. 39 is an outer appearance perspective view of the cap in the second embodiment. In FIG. 39, the configuration at the inner side (side at which a cap 900*a* makes contact with the cartridge 20 when the cartridge 20 is attached) of the cap 900*a* in the second embodiment is indicated by dashed lines for being understood easily.

As illustrated in FIG. 39, the cap 900*a* in the second embodiment is different from the cap 900 in the first embodiment as illustrated in FIG. 17 and the like in respects that the engagement hole 921 is omitted and a pair of cover-side engagement portions 940 are included at the inner side of the third side wall portion 904. Other configurations of the cap 900*a* in the second embodiment are the same as those of the cap 900 in the first embodiment. Although not illustrated in the drawings, a cartridge in the second embodiment is different from the cartridge 20 in the first embodiment in a respect that the second locking portion 221 is not included. Other configurations of the cartridge in the second embodiment are the same as those of the cartridge 20 in the first embodiment. The pair of cover-side engagement portions 940 have claw-like outer appearance shapes and project in the +X direction at the inner side of the third side wall portion 904. The pair of cover-side engagement portions 940 have substantially the same outer appearance shapes as the above-mentioned pair of holder engagement portions 621 of the holder 60*a*.

Figure 40:
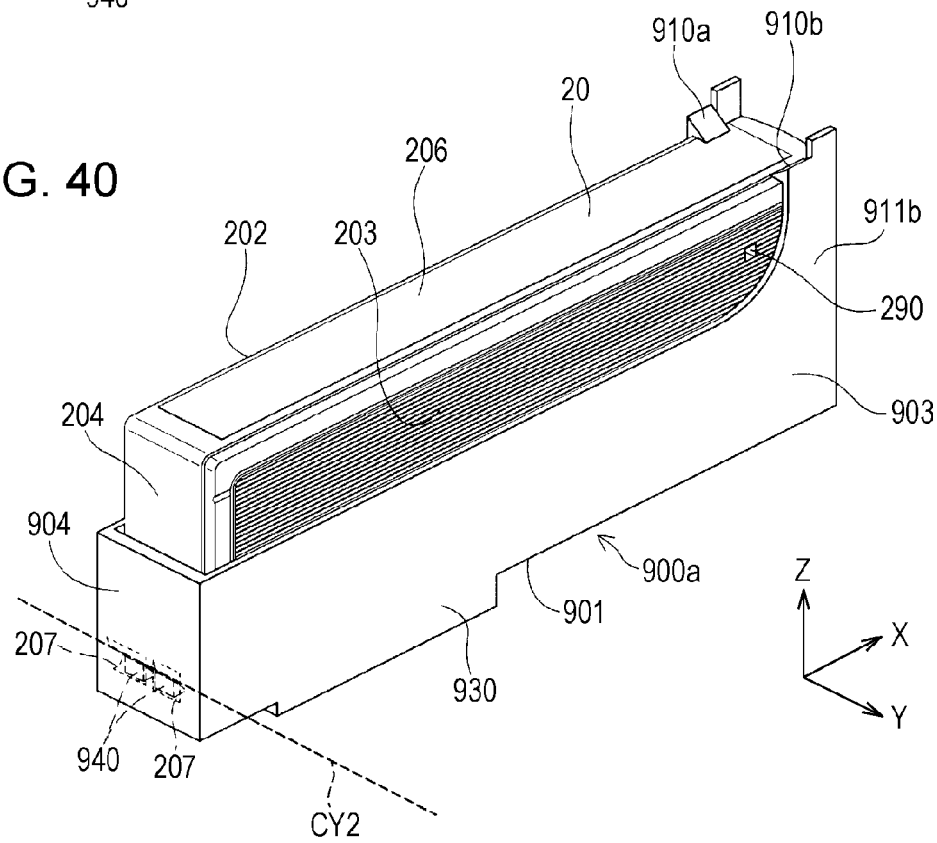
FIG. 40 is an outer appearance perspective view of the cartridge to which the cap according to the second embodiment is attached.

FIG. 40 is an outer appearance perspective view of the cartridge 20 to which the cap 900*a* in the second embodiment is attached. In FIG. 40, the cover-side engagement portions 940 of the cap 900*a* and the recesses 207 of the cartridge 20 are indicated by dashed lines for being understood easily.

As illustrated in FIG. 40, in the state where the cap 900*a* is attached to the cartridge 20, the pair of cover-side engagement portions 940 of the cap 900*a* are inserted into the pair of recesses 207 of the cartridge 20. This makes it possible to position the cap 900*a* and the cartridge 20 in the width direction (Y-axis direction) reliably. To be more specific, in the state where the cap 900*a* is attached to the cartridge 20, if the cap 900*a* tries to move in the +Y-axis direction with respect to the cartridge 20, one of the cover-side engagement portions 940 (cover-side engagement portion 940 at the −Y-axis direction side) hits a wall between the pair of cover-side engagement portions 940 so that movement thereof in the +Y-axis direction is restricted. In the same manner, in the state where the cap 900*a* is attached to the cartridge 20, if the cap 900*a* tries to move in the −Y-axis direction with respect to the cartridge 20, the other one of the cover-side engagement portions 940 (cover-side engagement portion 940 at the +Y-axis direction side) hits the wall between the pair of cover-side engagement portions 940 so that movement thereof in the −Y-axis direction is restricted.

In FIG. 40, a virtual line CY2 passes through the upper ends of the recesses 207 in the vertical direction and extends in the Y-axis direction (direction toward the third surface 203 from the second surface 202).

Figure 41:
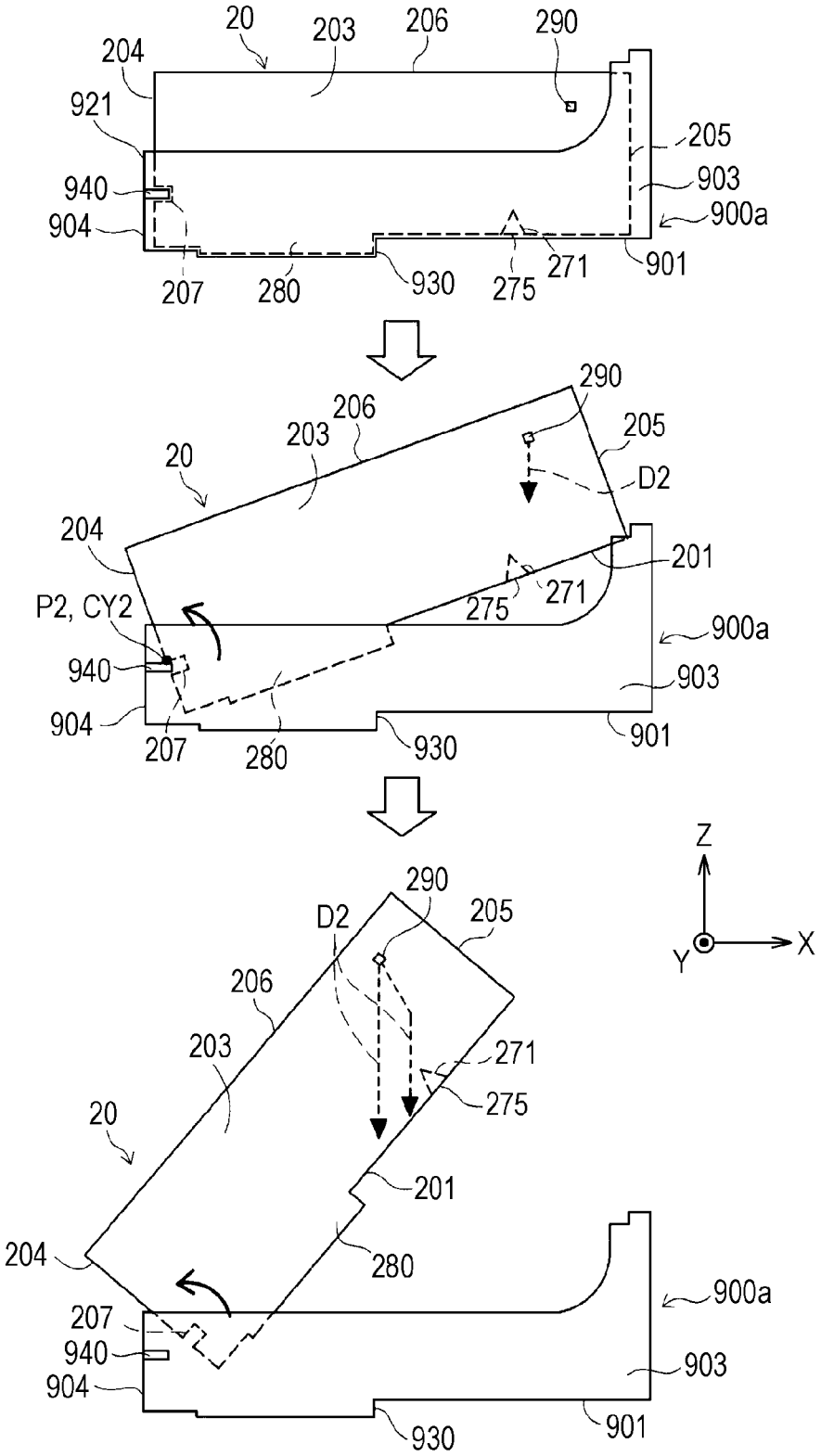
FIG. 41 is a descriptive view schematically illustrating a state when the cap is detached from the cartridge in the second embodiment.

FIG. 41 is a descriptive view illustrating the state where the cap 900*a* is detached from the cartridge 20 in the second embodiment. In FIG. 41, the cartridge 20 and the cap 900*a* are illustrated when seen from the −Y-axis direction in the same manner as FIG. 36. It is to be noted that in FIG. 41, the outer appearance (contour) of the cartridge 20 is illustrated schematically as in the same manner as FIG. 36.

In the state where the cap 900*a* is attached to the cartridge 20 as illustrated in the upper portion in FIG. 41, if a user deflects the first erecting portion 911*a* of the cap 900*a* in the −Y-axis direction and deflects the second erecting portion 911*b* of the cap 900*a* in the +Y-axis direction, the two top pawl portions 910*a* and 910*b* are separated from the sixth surface 206 of the cartridge 20 and the two side pawl portions 920*a* and 920*b* are separated from the fifth surface 205 of the cartridge 20. If the user tries to lift the cartridge 20 (tries to move the cartridge 20 so as to be separated from the cap 900*a*) while fixing the cap 900*a* in this state, the cartridge 20 is moved rotationally about a portion on which the recesses 207 of the cartridge 20 and the cover-side engagement portions 940 of the cap 900*a* make contact with each other as illustrated in the middle portion in FIG. 41. To be more specific, the cartridge 20 is moved rotationally in the direction of being separated from the cap 900*a* about the virtual line CY2 as illustrated in FIG. 40. In this case, the cartridge 20 is moved rotationally so as to be parallel with the plane that is parallel with the X-axis and the Z-axis.

As illustrated in the middle portion in FIG. 41, if ink leaks from the air introduction port 290 during the rotational movement of the cartridge 20, the leaked ink D2 moves to the lower side in the vertical direction (−Z-axis direction) and flows toward the transmitting surface 275. However, as illustrated in the lower position in FIG. 41, if the cartridge 20 is further moved rotationally in the direction of being separated from the cap 900*a*, the ink D2 leaked from the air introduction port 290 flows in the direction of being distanced from the transmitting surface 275.

As described above, the state where the cap 900*a* is detached from the cartridge 20 in the second embodiment is different from the state where the cap 900 is detached from the cartridge 20 in the first embodiment as illustrated in FIG. 36 in a respect that the rotational center is deviated in the −Z-axis direction slightly. Other operations in the state are the same as those in the state in the first embodiment. Accordingly, when the cartridge 20 is attached to the holder 60*a* after the cap 900*a* has been detached from the cartridge 20 completely, the same state as the state where the cartridge 20 is attached to the holder 60 in the first embodiment as illustrated in FIG. 37 is realized. Therefore, ink D2 leaked from the air introduction port 290 is present at a position closer to the fourth surface 204 relative to the transmitting surface 275 and flows toward the lower side in the vertical direction (−Z-axis direction) at the corresponding position like the ink D1 in the first embodiment. Therefore, the ink D2 does not adhere to the transmitting surface 275 so that false detection of presence/absence of ink is suppressed when the transmitting surface 275 is irradiated with light through the through-hole 636.

It is to be noted that in the second embodiment, the above-mentioned pair of recesses 207 correspond to a container-side engagement portion in the scope of the invention. Further, in the second embodiment, the pair of cover-side engagement portions 940 correspond to a cover-side engagement portion in the scope of the invention. Also in the second embodiment as described above, the same effects as those obtained in the first embodiment are obtained.

Third Embodiment

Figure 42:
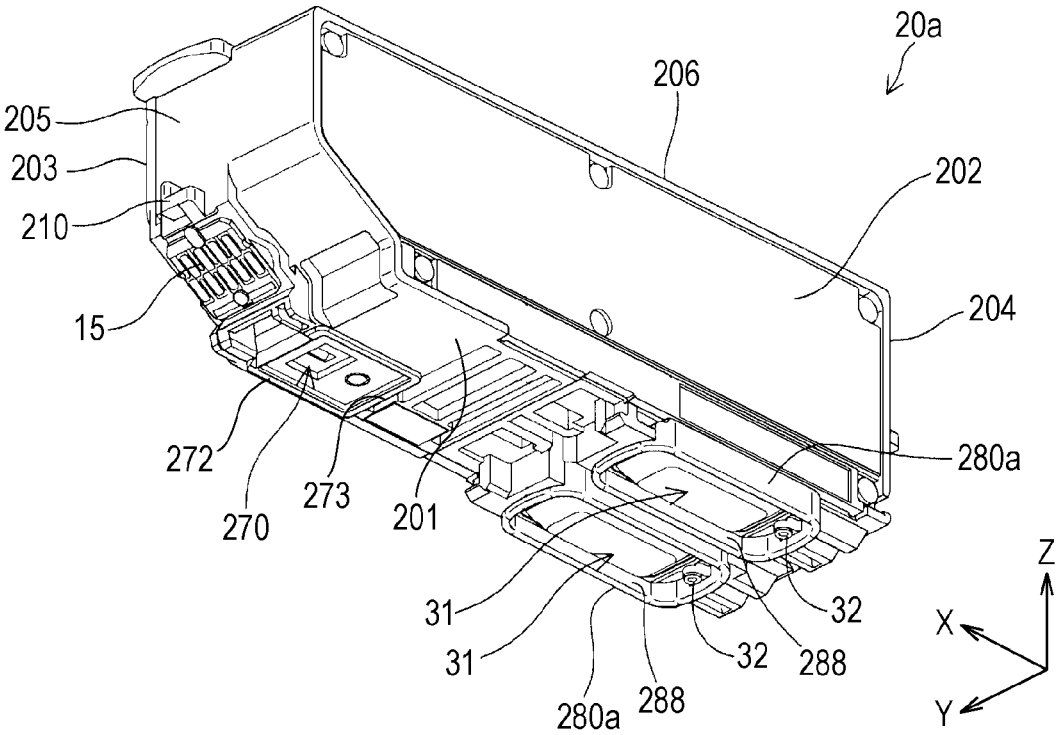
FIG. 42 is a perspective view illustrating a cartridge according to a third embodiment.
Figure 43:
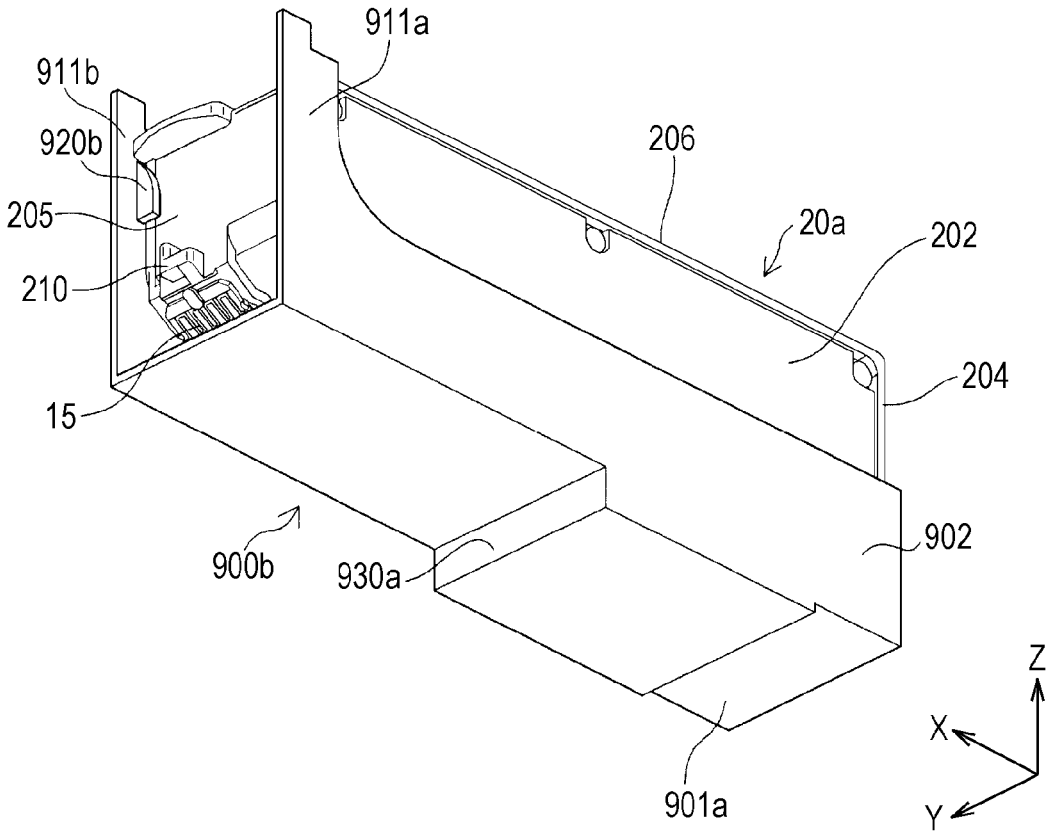
FIG. 43 is a perspective view of the cartridge to which a cap according to the third embodiment is attached.

FIG. 42 is a perspective view illustrating a cartridge 20*a* according to a third embodiment. FIG. 43 is a perspective view of the cartridge 20*a* to which a cap 900*b* according to the third embodiment is attached. The dimension of the cartridge 20*a* in the third embodiment in the Y-axis direction is larger than that of the cartridge 20 in the first embodiment. The cartridge 20*a* is attached to the holder 60 by using a space of two slots of the holder 60 (FIG. 2, FIG. 3). The cartridge 20*a* can accommodate a larger amount of ink than the cartridge 20 in the first embodiment.

As illustrated in FIG. 42, the cartridge 20*a* includes two liquid supply portions 280*a* projecting from the first surface 201. The two liquid supply portions 280*a* have the same configurations as the liquid supply portion 280 in the first embodiment. That is to say, ink in the cartridge 20*a* in the third embodiment is diverged into and supplied to the printer 50 from the two liquid supply portions 280*a*.

As illustrated in FIG. 43, a single cap 900*b* closing two openings 288 is attached to the cartridge 20*a*. The dimension of the cap 900*b* in the third embodiment in the Y-axis direction is larger than that of the cap 900 in the first embodiment. To be more specific, the dimension of the bottom portion 901*a* of the cap 900*b* in the third embodiment in the Y-axis direction is larger than that of the bottom portion 901 in the first embodiment. Further, the dimension of the protrusion 930*a* of the cap 900*b* in the third embodiment in the Y-axis direction is larger than that of the protrusion 930 of the cap 900 in the first embodiment. Other configurations of the cap 900*b* in the third embodiment are the same as those of the cap 900 in the first embodiment and description thereof is omitted. In the above-mentioned third embodiment, the same effects as those obtained in the first embodiment are also obtained.

Variations

1. First Variation

Although a what-is-called semi-sealed type cartridge has been described as an example in the above-described embodiments, the invention may be applied to other types of cartridges. For example, the invention can be also applied to an ink cartridge of a type in which the liquid accommodation portion 200 communicates with the outside all the time, and an ink cartridge (what-is-called ink pack) of a type in which the liquid accommodation portion 200 is sealed all the time.

2. Second Variation

Although the liquid supply portion 280 (opening 288) is covered by using the cap 900, 900*a* or 900*b* in the above-described embodiments, the liquid supply portion 280 can be also covered by using a sheet-like member (film) instead of the cap 900, 900*a* or 900*b*. To be more specific, a sheet member made of a synthetic resin (for example, material containing nylon and polypropylene) is wound around the first surface 201 of the cartridge 20 or 20*a*, the third surface 203, the sixth surface 206, and the second surface 202 so as to cover the liquid supply portion 280. That is to say, in general, an arbitrary cover that covers the liquid supply portion 280 and can make contact with the wall portion 272 formed on the first surface 201 can be employed as a cover according to the invention.

3. Third Variation

In the above-described embodiment, employed is the expression that the protrusions 223 and the recesses 224 forming grooves are formed on the surface of the lid member 24 that forms the third surface 203 so as to be aligned alternately in the Z-axis direction. However, an expression that the protrusions 223 are formed or the recesses 224 are formed simply can be also employed. When the expression that the protrusions 223 are formed is employed, the spaces 225 can be expressed to be formed by the second side wall portion 903 and the protrusions 223. Alternatively, when the expression that the recesses 224 are formed is employed, the spaces 225 can be expressed to be formed by the second side wall portion 903 and the recesses 224.

4. Fourth Variation

In the above-mentioned embodiment, the second side wall portion 903 makes contact with the protrusions 223 in a state where the cap 900, 900*a* or 900*b* is attached to the cartridge 20 or 20*a*. However, instead of the configuration in which the second side wall portion 903 makes contact with the protrusions 223, it is sufficient that the second side wall portion 903 only covers a region on which the protrusions 223 are formed without making contact with the protrusions 223. This is because if the second side wall portion 903 covers the protrusions 223, capillary forces act on between the second side wall portion 903 and the protrusions 223 so as to hold ink (liquid). That is to say, a configuration in which the second side wall portion 903 covers the protrusions 223 to the extent that the liquid can be held between the second side wall portion 903 and the protrusions 223 can be employed.

Further, when the expression that not the protrusions 223 but the recesses 224 are formed on the surface of the lid member 24 that forms the third surface 203 is employed as in the above-mentioned third variation, it is sufficient that the second side wall portion 903 only covers a region on which the recesses 224 are formed. This is because if the second side wall portion 903 covers the recesses 224, capillary forces act on between the second side wall portion 903 and the recesses 224 so as to hold ink (liquid). That is to say, a configuration in which the second side wall portion 903 covers the recesses 224 to the extent that the liquid can be held between the second side wall portion 903 and the recesses 224 can be employed.

5. Fifth Variation

The expression that the protrusions 223 are provided so as to extend in the X-axis direction is employed in the above-mentioned embodiments. However, the protrusions 223 can be also expressed to be provided so as to extend in the direction intersecting with a virtual surface which passes through the air introduction port 290 and is parallel with the Z-axis, in the direction toward the fifth surface from the fourth surface, or in the direction toward the fourth surface from the fifth surface. As the reason for this, it is sufficient that the ink flowed into between the second side wall portion 903 and the lid member 24 is held in the spaces 225 and is suppressed from flowing to the upper side and the lower side in the vertical direction.

6. Sixth Variation

In the above-mentioned embodiment, the air introduction port 290 is opened in any of the cases where the cap 900,900*a* or 900*b* is attached to and is not attached to the cartridge 20 or 20*a*. However, the invention is not limited thereto. For example, a configuration in which the lid member is inserted into the air introduction port 290 so as to close the air introduction port 290 can be employed. Alternatively, a configuration in which the sheet-like member as described in the above-mentioned first variation is wound around the cartridge 20 or 20*a* so as to cover the air introduction port 290 can be employed. With this configuration, the air introduction port 290 is covered, thereby suppressing ink leakage from the air introduction port 290.

In this configuration, it is preferable that the above-mentioned lid member or the sheet-like member be detached from the cartridge 20 or 20*a* before the cap 900, 900*a* or 900*b* being detached. If the lid member or the sheet-like member is detached before the cap 900, 900*a* or 900*b* being detached, the air introduction port 290 is opened. This causes a risk that the pressure in the liquid supply portion 280 communicating with the air introduction port 290 is lowered and ink leaks into the liquid supply portion 280 from the liquid accommodation portion 200 at a high pressure. However, since the cap 900, 900*a* or 900*b* is being attached to the cartridge 20 or 20*a*, adherence of the ink leaked out into the liquid supply portion 280 to a user or the printer 50 can be suppressed. In order to realize the detachment of the sheet-like member wound around the cartridge 20 or 20*a* before the cap 900, 900*a* or 900*b* being detached, for example, a configuration in which at least a part of the cap 900, 900*a* or 900*b* is covered by the sheet-like member in the state where the cap 900, 900*a* or 900*b* is attached to the cartridge 20 or 20*a* can be employed.

7. Seventh Variation

The invention can be applied to not only the ink jet printer and the ink cartridge thereof but also arbitrary liquid discharge apparatuses that consume liquids other than ink and cartridges (liquid containers) to be used in the liquid discharge apparatuses. For example, the invention can be applied to cartridges to be used in various types of liquid ejecting apparatuses as follows.

(1) Image recording apparatuses such as a facsimile device
(2) Color material ejecting apparatuses to be used for manufacturing a color filter for image display devices such as a liquid crystal display
(3) Electrode material ejecting apparatuses to be used for forming electrodes of organic electro luminescence (EL) displays, field emission displays (FEDs), and the like
(4) Liquid ejecting apparatuses that eject liquid containing a bioorganic substance to be used for manufacturing a biochip
(5) Specimen ejecting apparatuses as precision pipettes
(6) Lubricating oil ejecting apparatuses
(7) Resin solution ejecting apparatuses
(8) Liquid ejecting apparatuses that pinpoint-eject lubricating oil to a precision machine such as a watch or a camera
(9) Liquid ejecting apparatuses which eject a transparent resin solution such as an ultraviolet curable resin solution onto a substrate in order to form a hemispherical microlens (optical lens) used for an optical communication element and the like
(10) Liquid ejecting apparatuses which eject an acid or alkali etching solution for etching a substrate or the like
(11) Liquid ejecting apparatuses including a liquid consumption head for discharging a minute amount of other arbitrary liquid droplets Note that the terminology "liquid droplets" represents the state of liquid which is discharged from the liquid discharge apparatus. For example, a granule form, a teardrop form, and a form that pulls tails in a string-like form therebehind are included as the liquid droplets. The terminology "liquid" here represents materials which can be consumed by the liquid discharge apparatus and any materials are included as long as the materials are in a liquid phase. For example, materials in a liquid state having high viscosity or low viscosity or a fluid state such as sol, gel water, other inorganic solvents, an organic solvent, a solution, a liquid resin or a liquid metal (molten metal) can be included as the "liquid". Further, the liquid is not limited to liquid as one state of a material but includes a solution, a dispersion or a mixture of particles of a functional material made of a solid material such as pigment particles or metal particles. Typical examples of the liquid are ink described in the above-mentioned embodiments and liquid crystals and the like. The terminology "ink" here encompasses various liquid compositions such as common aqueous ink and oil ink, gel ink and hot melt ink and the like.

8. Eighth Variation

In the above-mentioned embodiments and the above-mentioned variations, the cartridge 20 or 20*a* and the cap 900, 900*a* or 900*b* are formed as different parts. However, the cartridge 20 or 20*a* including the cap 900, 900*a* or 900*b* can be also considered as the cartridge 20 or 20*a*. That is to say, a liquid container to which the cover according to the invention is attached can be realized as the liquid container.

9. Ninth Variation

In the above-mentioned embodiments, presence/absence of ink in the liquid accommodation portion 200 is detected by using the prism unit 270. However, an ink residual amount can be detected optically by using a well-known detection member instead.

10. Tenth Variation

In the cap 900 in the above-mentioned first embodiment and the cap 900*b* in the above-mentioned third embodiment, the engagement hole 921 can be also omitted. With this configuration, the second locking portion 221 of the cartridge 20 or 20*a* abuts against the inner side of the cap 900. Also in this configuration, the cap 900 and the cartridge 20 or the cap 900*b* and the cartridge 20*a* can be engaged with each other reliably by using the pair of top pawl portions 910*a* and 910*b* and the pair of side pawl portions 920*a* and 920*b*. In the same manner, the pair of cover-side engagement portions 940 can be omitted in the cap 900*a* in the second embodiment. In this configuration, when the cartridge 20 is attached to the cap 900*a*, nothing is inserted into the recesses 207 of the cartridge 20. Also in this configuration, the cap 900*a* and the cartridge 20 can be engaged with each other reliably by the pair of top pawl portions 910*a* and 910*b* and the pair of side pawl portions 920*a* and 920*b*.

11. Eleventh Variation

In the above-mentioned embodiments, the air introduction port 290 is formed on the third surface 203. However, instead of the third surface 203, the air introduction port 290 may be formed on any of the second surface 202, the fifth surface 205, and the fourth surface 204.

12. Twelfth Variation

In the above-mentioned embodiments, the portion in which ink is accommodated corresponds to the liquid accommodation portion 200 in the cartridge 20 or 20*a*. However, the invention is not limited thereto. For example, a configuration in which the cartridge 20 or 20*a* does not include the liquid accommodation portion 200 and the liquid accommodation portion is provided in an ink supply unit that can be attached to the cartridge 20 or 20*a* can be employed. In this configuration, the liquid accommodation portion in the ink supply unit and the liquid supply portion 280 are made to communicate with each other so as to supply ink to the liquid supply portion 280 from the liquid accommodation portion.

It is to be noted that in the above-mentioned embodiments and variations, expressions of "abut", "be contact with", "make contact with", and the like indicate a wide concept including not only the states where one member abuts against, is contact with, makes contact with the other member but also a state where one member covers the other member simply without being contact with the other member. That is to say, the expressions indicate states where at least the function to be realized by sealing or abutment, to be more specific, the function of reducing the possibility that liquid scatters and so on can be exerted.

The invention is not limited to the above-mentioned embodiments and variations and can be realized with various configurations in the range without departing from the scope thereof. For example, the technical characteristics in the embodiments and the variations corresponding to the technical characteristics in the respective aspects described in the summary of the invention can be replaced or combined appropriately in order to solve a part or all of the above-mentioned problems or achieve a part or all of the above-mentioned effects. In addition, the technical characteristics can be omitted appropriately if the technical characteristics are not described as essential characteristics in the specification.

What is claimed is:

1. A cover that is removably attachable to a liquid container, the liquid container attachable to a liquid discharge apparatus, the liquid container including:

a first surface having a wall and a liquid communication portion, the wall surrounding the liquid communication portion, a liquid accommodation portion, the communication portion communicating with the liquid accommodation portion and supplying liquid to the liquid discharge apparatus;

a second surface, which intersects with the first surface;

a third surface, which intersects with the first surface and is opposite to the second surface;

a fourth surface, which intersects the first surface, the second surface, and the third surface;

a fifth surface, which intersects the first surface, the second surface, the third surface and is opposite to the fourth surface, the fourth surface having a rib protruding in a direction from the fifth surface toward the fourth surface; and a sixth surface, which intersects the second surface, the third surface, the fourth surface, and the fifth surface, and is opposite to the first surface, the wall protruding from the first surface in a direction from the sixth surface toward the first surface, the cover comprising:

a bottom portion having a protrusion protruding in a direction from the sixth surface toward the first surface when the cover is attached to the liquid container, the protrusion being configured to receive an insertion of the wall into the protrusion;

a first side wall portion intersecting the bottom portion, the first side wall portion facing the second surface of the liquid container when the cover is attached to the liquid container;

a second side wall portion intersecting the bottom portion and opposite to the first side wall portion, the second side wall portion facing the third surface of the liquid container when the cover is attached to the liquid container;

a third side wall portion intersecting the bottom portion, the first side wall portion, and the second side wall portion, the third side wall portion facing the fourth surface of the liquid container when the cover is attached to the liquid container, the third side wall portion having an engagement hole configured to receive an insertion of the rib into the engagement hole, when the cover is attached to the liquid container; and a top pawl portion intersecting the first side wall portion and opposite to the bottom portion, the top pawl portion being configured to be contacted with the sixth surface of the liquid container when the cover is attached to the liquid container.

2. The cover according to claim 1, wherein the top pawl portion is connected to the first side wall portion.

3. The cover according to claim 1, wherein the top pawl portion is located between the first side wall portion and the second side wall portion.

4. The cover according to claim 1, further comprising:

a side pawl portion intersecting the first side wall portion and opposite to the third side wall portion, the side pawl portion being configured to contact the fifth surface of the liquid container when the cover is attached to the liquid container.

5. The cover according to claim 4, wherein the side pawl portion is connected to the first side wall portion.

6. The cover according to claim 5, wherein the side pawl portion is located between the first side wall portion and the second side wall portion.

7. A cartridge system comprising:

(a) a liquid container configured to be attached to a liquid discharge apparatus, the liquid container including:

a first surface having a wall, a liquid communication portion and a liquid accommodation portion, the wall surrounding the liquid communication portion, the liquid communication portion communicating with a liquid accommodation portion and supplying liquid to the liquid discharge apparatus;

a second surface, which intersects with the first surface;

a third surface, which intersects with the first surface and is opposite to the second surface;

a fourth surface, which intersects the first surface, the second surface, and the third surface;

a fifth surface, which intersects the first surface, the second surface, the third surface and is opposite to the fourth surface, the fourth surface having a rib protruding in a direction from the fifth surface toward the fourth surface; and a sixth surface, which intersects the second surface, the third surface, the fourth surface, and the fifth surface and is opposite to the first surface, the wall protruding from the first surface in a direction from the sixth surface toward the first surface; and (b) a cover attached to the liquid container, the cover including:

a bottom portion having a protrusion protruding in a direction from the sixth surface toward the first surface and the wall of the first surface is inserted into the protrusion;

a first side wall portion intersecting the bottom portion, the first side wall portion facing the second surface of the liquid container;

a second side wall portion intersecting the bottom portion and opposite to the first side wall portion, the second side wall portion facing the third surface of the liquid container;

a third side wall portion intersecting the bottom portion, the first side wall portion, and the second side wall portion, the third side wall portion facing the fourth surface of the liquid container, the third side wall having an engagement hole and the rib of the fourth surface of the liquid container is inserted into the engagement hole; and a top pawl portion intersecting the first side wall portion and opposite to the bottom portion, the top pawl portion contacting the sixth surface of the liquid container.

8. The cartridge according to claim 7, wherein the top pawl portion is connected to the first side wall portion.

9. The cartridge according to claim 7, wherein the top pawl portion is located between the first side wall portion and the second side wall portion.

10. The cartridge according to claim 7, further comprising:

a side pawl portion intersecting the first side wall portion and opposite to the third side wall portion, the side pawl portion contacting the fifth surface of the liquid container.

11. The cartridge according to claim 10, wherein the side pawl portion is connected to the first side wall portion.

12. The cartridge according to claim 10, wherein the side pawl portion is located between the first side wall portion and the second side wall portion.

* * * * *